US010047411B2

(12) United States Patent
Ueda et al.

(10) Patent No.: US 10,047,411 B2
(45) Date of Patent: Aug. 14, 2018

(54) RAIL

(71) Applicant: NIPPON STEEL & SUMITOMO METAL CORPORATION, Tokyo (JP)

(72) Inventors: Masaharu Ueda, Kitakyushu (JP); Takeshi Yamamoto, Kitakyushu (JP); Teruhisa Miyazaki, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/544,686

(22) PCT Filed: Jan. 22, 2016

(86) PCT No.: PCT/JP2016/051890

§ 371 (c)(1),
(2) Date: Jul. 19, 2017

(87) PCT Pub. No.: WO2016/117692

PCT Pub. Date: Jul. 28, 2016

(65) Prior Publication Data

US 2017/0369961 A1 Dec. 28, 2017

(30) Foreign Application Priority Data

Jan. 23, 2015 (JP) ..... 2015-011007

(51) Int. Cl.
*C21D 9/04* (2006.01)
*E01B 5/02* (2006.01)
(Continued)

(52) U.S. Cl.
CPC ..... *C21D 9/04* (2013.01); *C22C 38/00* (2013.01); *C22C 38/04* (2013.01); *C22C 38/105* (2013.01); *C22C 38/58* (2013.01); *E01B 5/02* (2013.01); *C21D 8/00* (2013.01); *C21D 2211/009* (2013.01)

(58) Field of Classification Search
None
See application file for complete search history.

(56) References Cited

U.S. PATENT DOCUMENTS 4,895,605 A 1/1990 Ackert et al.
2001/0023724 A1 9/2001 Moser et al.
(Continued)

FOREIGN PATENT DOCUMENTS

CN 1622311 A 8/2004
CN 102859010 A 1/2013
(Continued)

OTHER PUBLICATIONS

International Search Report (PCT/ISA/210) issued in PCT/JP2016/051890, dated Apr. 19, 2016.
(Continued)

*Primary Examiner* — Adam Krupicka
(74) *Attorney, Agent, or Firm* — Birch, Stewart, Kolasch & Birch, LLP

(57) ABSTRACT

The present invention relates to a rail which has a predetermined chemical composition and in which at least 90% of a metallographic structure from an outer surface of the rail bottom portion, as the origin, to a depth of 5 mm is a pearlite structure, a surface hardness HC of a foot-bottom central portion is in a range of Hv 360 to 500, a surface hardness HE of a foot-edge portion is in a range of Hv 260 to 315, and HC, HE, and a surface hardness HM of a middle portion positioned between the foot-bottom central portion and the foot-edge portion satisfy HC≥HM≥HE.

4 Claims, 8 Drawing Sheets

(51) Int. Cl.

| | |
|---|---|
| ***C22C 38/00*** | (2006.01) |
| ***C22C 38/04*** | (2006.01) |
| ***C22C 38/58*** | (2006.01) |
| ***C22C 38/10*** | (2006.01) |
| *C21D 8/00* | (2006.01) |

(56) References Cited

U.S. PATENT DOCUMENTS

| | | | |
|---|---|---|---|
| 2004/0035507 | A1 | 2/2004 | Cordova |
| 2011/0226389 | A1 | 9/2011 | Ueda et al. |
| 2011/0253268 | A1 | 10/2011 | Zou et al. |
| 2016/0040263 | A1 | 2/2016 | Okushiro et al. |

FOREIGN PATENT DOCUMENTS

| | | | |
|---|---|---|---|
| CN | 102985574 | A | 3/2013 |
| CN | 104185690 | A | 12/2014 |
| GB | 1 370 144 | A | 10/1974 |
| JP | 63-023244 | B2 | 5/1988 |
| JP | 1-139724 | A | 6/1989 |
| JP | 2005-290486 | A | 6/1989 |
| JP | 4-202626 | A | 7/1992 |
| JP | 47-007606 | A | 7/1992 |
| JP | 8-144016 | A | 6/1996 |
| JP | 2006-057128 | A | 3/2006 |
| JP | 2008-266675 | A | 11/2008 |
| WO | WO 2011/021582 | A1 | 2/2011 |
| WO | WO 2014/157198 | A1 | 10/2014 |

OTHER PUBLICATIONS

Written Opinion (PCT/ISA/237) issued in PCT/JP2016/051890, dated Apr. 19, 2016.

Australian Office Action for counterpart Application No. 2016210110, dated Jun. 18, 2018.

Chinese Office Action and Search Report for counterpart Application No. 201680006505.6, dated May 30, 2018, with an English translation of the Search Report.

RAIL

TECHNICAL FIELD OF THE INVENTION

The present invention relates to a rail having excellent breakage resistance and fatigue resistance in high-strength rails used in cargo railways. Priority is claimed on Japanese Patent Application No. 2015-011007, filed on Jan. 23, 2015, the content of which is incorporated herein by reference.

RELATED ART

With economic development, natural resources such as coal have been newly developed. Specifically, mining in regions with severe natural environments which were not developed yet has been promoted. Along with this, the railroad environment of cargo railways used to transport resources has become significantly severe. Therefore, rails have been required to have more wear resistance than ever. From this background, there has been a demand for development of rails with improved wear resistance.

Further, in recent years, railway transport has been further overcrowded and, therefore, a possibility that breakage or fatigue damage is generated from rail bottom portions has been pointed out. Consequently, for further improvement of rail service life, there has been a demand for improvement of the breakage resistance and fatigue resistance of rails in addition to wear resistance.

In order to improve the wear resistance of rail steel, for example, high-strength rails described in Patent Documents 1 to 5 have been developed. Main characteristics of these rails are the hardness of steel being increased by refining pearlite lamellar spacing using a heat treatment in order to improve the wear resistance and an increased volume rate of cementite in pearlite lamellar by increasing the amount of carbon of steel.

Patent Document 1 discloses that a rail with excellent wear resistance is obtained by performing accelerated cooling on a rail head portion which is rolled or re-heated at a cooling rate of 1° C./sec to 4° C./sec from the temperature of an austenite region to a range of 850° C. to 500° C.

In addition, Patent Document 2 discloses that a rail having excellent wear resistance can be obtained by increasing the volume ratio of cementite in lamellar of a pearlite structure using hyper-eutectoid steel (C: greater than 0.85% and 1.20% or less).

In disclosed technologies of Patent Documents 1 and 2, the wear resistance of a rail head portion is improved so that a certain length of service life is increased by refining lamellar spacing in pearlite structure in order to improve the hardness and increasing the volume ratio of cementite in lamellar of pearlite structure. However, in the rails disclosed in Patent Documents 1 and 2, the breakage resistance and the fatigue resistance of a rail bottom portion are not examined.

Further, for example, Patent Documents 3 to 5 disclose a method of performing a heat treatment on a rail bottom portion for the purpose of controlling the material of the rail bottom portion and preventing breakage originated from the rail bottom portion. According to the technologies disclosed in these documents, it is suggested that the service time of rails can be drastically improved.

Specifically, Patent Document 3 discloses a heat treatment method of performing accelerated cooling on the rail bottom surface at a cooling rate of 1° C./sec to 5° C./sec from a temperature range of 800° C. to 450° C. while performing accelerated cooling on the rail head portion from the temperature of the austenite region after rail rolling. Further, according to the heat treatment method, it is disclosed that a rail having improved characteristics of drop weight resistance and breakage resistance can be provided by adjusting pearlite structure average hardness of the rail bottom portion to HB 320 or greater.

Patent Document 4 discloses that a rail having improved drop weight characteristics and excellent breakage resistance can be provided by re-heating the rail bottom portion which is rolled and subjected to a heat treatment in a temperature range of 600° C. to 750° C., spheroidizing pearlite structure, and then performing rapid cooling on the rail bottom portion.

Patent Document 5 discloses a method of setting the hardness of a foot-edge portion to Hv 320 or greater by re-heating the foot-edge portion of a rail in a temperature range of an Ar3 transformation point or an Arcm transformation point to 950° C., performing accelerated cooling on the foot-edge portion at a cooling rate of 0.5° C. to 20° C., stopping the accelerated cooling at 400° C. or higher, performing air cooling or accelerated cooling on the foot-edge portion to room temperature, further re-heating the foot-edge portion to a temperature range of 500° C. to 650° C., and performing air cooling or accelerated cooling on the foot-edge portion to room temperature. It is disclosed that a rail having excellent breakage resistance can be provided when this method is used because generation of fatigue damage to the foot-edge portion, generation of breakage due to fatigue damage, and generation of breakage due to brittle fractures caused by an excessively impact load, among the breakage in the rail bottom portion, can be suppressed.

According to the disclosed technology of Patent Document 3, since the hardness of pearlite structure is improved by performing accelerated cooling on the rail bottom portion, the characteristics of drop weight resistance or fatigue resistance for which strength is mainly required are improved. However, the toughness is degraded due to high hardness, the breakage resistance is unlikely to be improved. Further, since a pro-eutectoid cementite harmful to the toughness is likely to be generated at the above-described cooling rate of the accelerated cooling in a case of rail steel having a high carbon content, the breakage resistance is unlikely to be improved from this viewpoint.

Further, according to the disclosed technology of Patent Document 4, since the entire rail bottom portion is re-heated and then the rail bottom portion is rapidly cooled, the toughness can be improved by tempering pearlite structure. However, since the structure is softened by the tempering, the fatigue resistance is unlikely to be improved.

Further, according to the disclosed technology of Patent Document 5, since the foot-edge portion of the rail is re-heated and then controlled cooling is performed, the hardness of pearlite structure is increased and pearlite structure can be refined. Moreover, a certain degree of toughness is obtained by tempering which is performed after the cooling. However, since the hardness of the structure is increased, the toughness is unlikely to be sufficiently improved and thus excellent breakage resistance is difficult to obtain.

PRIOR ART DOCUMENT

Patent Document

[Patent Document 1] Japanese Examined Patent Application, Second Publication No. S63-023244

[Patent Document 2] Japanese Unexamined Patent Application, First Publication No. H08-144016

[Patent Document 3] Japanese Unexamined Patent Application, First Publication No. H01-139724

[Patent Document 4] Japanese Unexamined Patent Application, First Publication No. H04-202626

[Patent Document 5] Japanese Unexamined Patent Application, First Publication No. 2008-266675

DISCLOSURE OF THE INVENTION

Problems to be Solved by the Invention

The present invention has been made in consideration of the above-described problems. An object of the present invention is to provide a rail having excellent breakage resistance and fatigue resistance which are required for rails of cargo railways and in which generation of breakage from a bottom portion can be suppressed.

Means for Solving the Problem

The scope of the present invention is as follows.

(1) According to an aspect of the present invention, a rail includes, as steel composition, in terms of mass %: C: 0.75% to 1.20%; Si: 0.10% to 2.00%; Mn: 0.10% to 2.00%; Cr: 0% to 2.00%; Mo: 0% to 0.50%; Co: 0% to 1.00%; B: 0% to 0.0050%; Cu: 0% to 1.00%; Ni: 0% to 1.00%; V: 0% to 0.50%; Nb: 0% to 0.050%; Ti: 0% to 0.0500%; Mg: 0% to 0.0200%; Ca: 0% to 0.0200%; REM: 0% to 0.0500%; Zr: 0% to 0.0200%; N: 0% to 0.0200%; Al: 0% to 1.00%; P: 0.0250% or less; S: 0.0250% or less; and Fe and impurities as a remainder.

90% or more of a metallographic structure in a range between an outer surface of a rail bottom portion as an origin and a depth of 5 mm is a pearlite structure, and an HC which is a surface hardness of a foot-bottom central portion is in a range of Hv 360 to 500. An HE which is a surface hardness of a foot-edge portion is in a range of Hv 260 to 315, and the HC, the HE, and an HM which is a surface hardness of a middle portion positioned between the foot-bottom central portion and the foot-edge portion satisfy the following Expression 1.

$$HC \geq HM \geq HE \quad \text{(Expression 1).}$$

(2) In the rail according to (1), the HM and the HC may satisfy the following Expression 2.

$$HM/HC \geq 0.900 \quad \text{(Expression 2)}$$

(3) In the rail according to (1) or (2), the steel composition may include, in terms of mass %, at least one selected from the group consisting of Cr: 0.01% to 2.00%, Mo: 0.01% to 0.50%, Co: 0.01% to 1.00%, B: 0.0001% to 0.0050%, Cu: 0.01% to 1.00%, Ni: 0.01% to 1.00%, V: 0.005% to 0.50%, Nb: 0.0010% to 0.050%, Ti: 0.0030% to 0.0500%, Mg: 0.0005% to 0.0200%, Ca: 0.0005% to 0.0200%, REM: 0.0005% to 0.0500%, Zr: 0.0001% to 0.0200%, N: 0.0060% to 0.0200%, and Al: 0.0100% to 1.00%.

Effects of the Invention

According to the aspect of the present invention, it is possible to provide a rail having excellent breakage resistance and the fatigue resistance, which are required for the rail bottom portion of cargo railways, by controlling the compositions of rail steel serving as the material of the rail, controlling the metallographic structure of the rail bottom portion and the surface hardness of the foot-bottom central portion and the foot-edge portion of the rail bottom portion, and controlling strain concentration on the vicinity of the middle portion, by controlling the balance of the surface hardness of the foot-bottom central portion, the foot-edge portion, and the middle portion.

EMBODIMENTS OF THE INVENTION

Hereinafter, a rail having excellent breakage resistance and fatigue resistance according to an embodiment of the present invention (hereinafter, also referred to as a rail according to the present embodiment) will be described in detail. Hereinafter, "%" in the composition indicates mass %.

First, the present inventors examined the details of the cause of breakage being generated from the rail bottom portion in the current cargo railways. As a result, it was found that rail breakage is mainly divided into two types of breakage forms based on the causes thereof. That is, the breakage is divided into two types of breakage forms which are brittle fracture in which the foot-edge portion of the rail bottom portion is the origin and fatigue fracture in which the foot-bottom central portion of the rail bottom portion is the origin.

Further, the occurrence of brittle fracture from the foot-edge portion as the origin is frequently found in the outside rail of a curved line section and the occurrence of the fatigue fracture from the foot-bottom central portion as the origin is frequently found in the rail of a straight line section.

In addition, in the brittle fracture occurring in the foot-edge portion of the outside rail of the curved line section, occurrence of fatigue cracks is not found. Therefore, it is assumed that the brittle fracture occurring in the foot-edge portion of the outside rail of the curved line section is breakage formed by impact stress being applied instantaneously.

Figure 7:
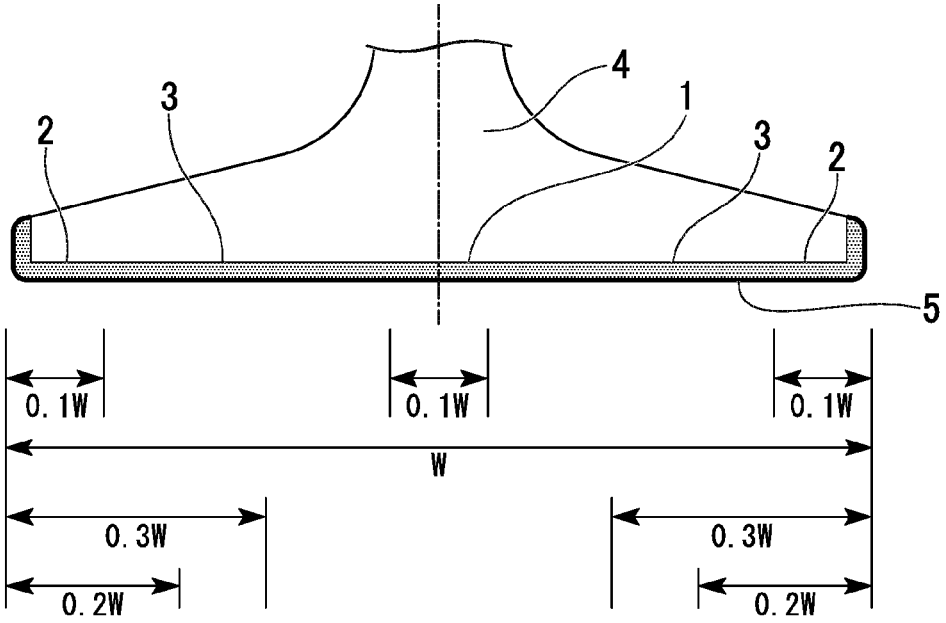
FIG. 7 is a graph showing names of each position of a rail bottom portion according to the present embodiment and a region for which pearlite structure is required.

FIG. 7 is a schematic view showing the rail bottom portion according to the present embodiment. The rail bottom portion (rail bottom portion 4) according to the present embodiment will be described with reference to FIG. 7.

The rail bottom portion 4 includes a foot-bottom central portion 1, a foot-edge portion 2 positioned on both ends of the foot-bottom central portion 1, and a middle portion 3 positioned between the foot-bottom central portion 1 and the foot-edge portion 2.

As shown in FIG. 7, the foot-edge portion 2 is a portion positioned in the vicinity of the both ends of the rail bottom portion 4 in the width direction and positioned close to an outer surface 5 of the rail bottom portion. Further, as shown in FIG. 7, the foot-bottom central portion 1 is a portion positioned in the vicinity of the center of the rail bottom portion 4 in the width direction and positioned close to the outer surface 5 of the rail bottom portion. Further, as shown in FIG. 7, the middle portion 3 is a portion positioned between the foot-edge portion 2 and the foot-bottom central portion 1 and positioned close to the outer surface 5 of the rail bottom portion. More specifically, when the width dimension of the rail bottom portion 4 in FIG. 7 is defined as W, the foot-bottom central portion 1 is in a region of 0.1 W interposed between the position of ±0.05 W and the width center of the rail bottom portion 4. Further, the foot-edge portion 2 positioned on both ends of the foot-bottom central portion 1 is in a region of 0.1 W from the end portion of the rail bottom portion 4 in the width direction. Further, the middle portion 3 positioned between the foot-bottom central portion 1 and the foot-edge portion 2 is in a region of 0.2 to 0.3 W from the end portion of the rail bottom portion 4 in the width direction.

In a case where the rail is seen from the vertical cross section in the length direction, a portion in which the width of the rail is constricted is present in the center of the rail in the height direction. A portion which has a width wider than the width of the constricted portion and is positioned on a side lower than the constricted portion is referred to as the rail bottom portion 4 and a portion which is positioned on a side upper than the constricted portion is referred to as a rail column portion or a head portion (not illustrated). Further, the outer surface 5 of the rail bottom portion indicates at least the surface, among the surfaces of the rail bottom portion, facing the lower side when the rail is upright. The outer surface 5 of the rail bottom portion may include the side end surfaces of the rail bottom portion.

In general, it is said that low hardness (soft) is effective for brittle fracture generated by impact stress being applied and high hardness (full hard) is effective for fatigue fracture. That is, contrary methods are necessary to improve these characteristics. Therefore, it is not easy to improve these characteristics simultaneously. The present inventors found that the hardness of the surface in each position of the bottom portion needs to be suitably controlled according to the main causes of generation of fracture, in order to suppress damage occurring in the rail bottom portion.

The present inventors examined the cause of occurrence of fatigue fracture originated from the foot-bottom central portion. Specifically, the stress applied to the surface of the bottom portion in the foot-bottom central portion from the foot-edge portion is measured by performing an actual rail bending fatigue test assuming heavy load railways using a rail which includes a steel composition with a 1.00% C, 0.50% Si, 0.90% Mn, P: 0.0250% or less, and S: 0.0250% or less (the remainder of the steel composition is Fe and impurities) and in which the hardness of the entire outer surface of the rail bottom portion from one foot-edge portion to the other foot-edge portion is set to be almost constant. The test conditions are as described below.

Actual Rail Bending Fatigue Test

Used Rail

Shape: 141 lbs rail (weight: 70 kg/m, width of bottom portion: 152 mm)

Metallographic structure of bottom portion: pearlite

Surface hardness of bottom portion: Hv 380 to 420 (average value at depth of 1 mm under surfaces between foot-edge portion and middle portion and between middle portion and foot-bottom central portion)

Conditions of Fatigue Test

Figure 8:
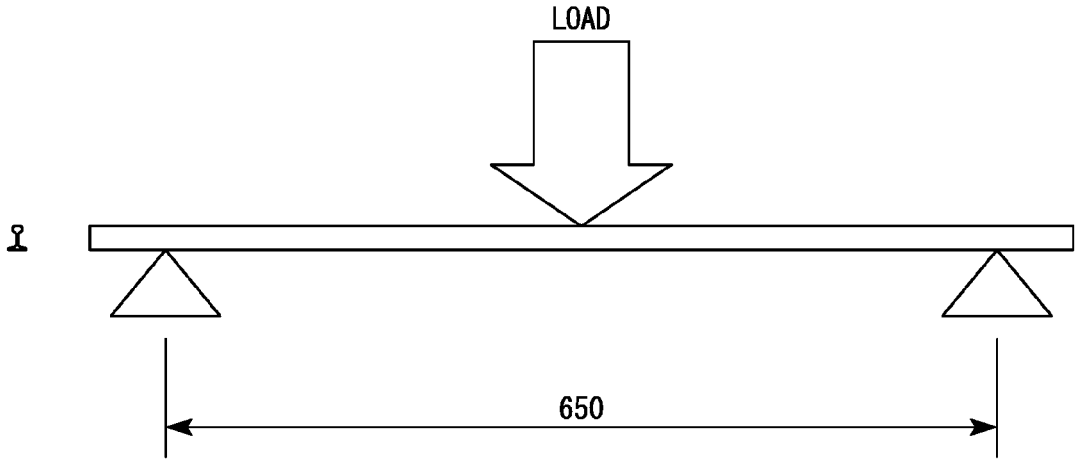
FIG. 8 is a side view showing the outline of a fatigue test of a rail.

Test method: 3 point bending of actual rail (span length: 0.65 m) (see FIG. 8)

Load condition: in range of 7 to 70 tons (frequency of applied load: 5 Hz)

Test attitude: load is applied to rail head portion (tensile stress is applied to rail bottom portion)

Stress Measurement

Figure 1:
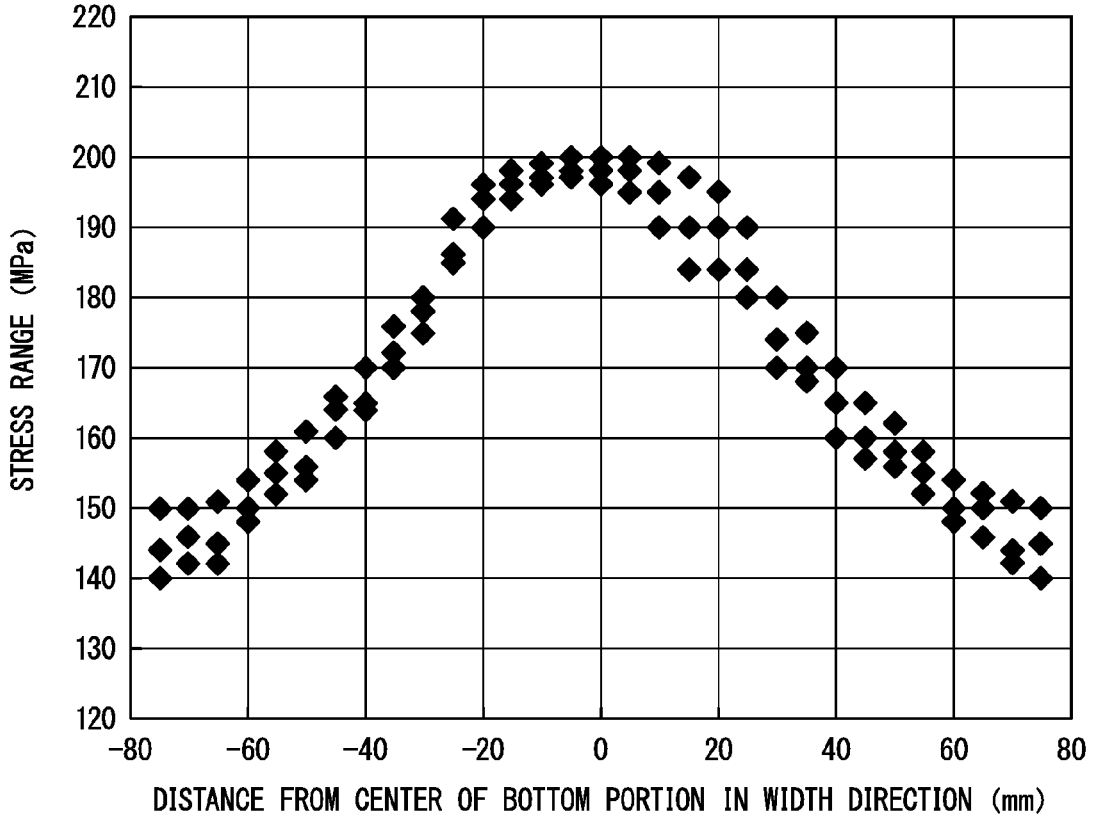
FIG. 1 is a graph showing measurement results of surface stress applied to a rail bottom portion.

Measurement method: measurement using strain gauge adhering to rail bottom portion FIG. 1 shows the relationship between the distance from the center on the surface of the rail bottom portion in the width direction and the measurement results of stress applied to the rail bottom portion. The vertical axis in FIG. 1 shows the stress range obtained by organizing the results of measuring the surface stress three times. As understood from FIG. 1, it was found that the stress range is greatly different for each position site in the rail bottom portion, the maximum stress is 200 MPa, which is the highest value and measured in the foot-bottom central portion, the stress monotonically decreases toward the foot-edge portion from the foot-bottom central portion, and the stress of the foot-edge portion in which restraint is less and deformation is easily made decreases to 150 MPa. Therefore, it is suggested that the surface hardness required for improving the fatigue resistance is different for each position because the load stress is different for each position in the rail bottom portion.

In order to clarify the surface hardness required for ensuring the fatigue resistance of each position of the rail, a plurality of rails A in which the hardness of the foot-bottom central portion is changed and a plurality of rails B in which the hardness of the foot-edge portion is changed are produced, by the present inventors, by performing hot rolling and a heat treatment on rail steel (steel serving as the material of the rail) which contains 1.00% C, 0.50% Si, 0.90% Mn, P: 0.0250% or less, and S: 0.0250% or less and the remainder of Fe and impurities. Further, a fatigue test is performed by reproducing the conditions of using actual tracks to the obtained rails A and B to investigate the fatigue limit stress range. The test conditions are as follows.

<Actual Rail Bending Fatigue Test (1)>

Used Rail

Shape: 141 lbs rail (weight: 70 kg/m, width of bottom portion: 152 mm)

Metallographic structure of bottom portion: pearlite

Hardness of Rail

Rail A having foot-bottom central portion of which hardness is controlled: surface hardness HC (Hv) of foot-bottom central portion: Hv 320 to 540, and surface hardness HE (Hv) of foot-edge portion: Hv 315 (constant)

Rail B having foot-edge portion of which hardness is controlled: surface hardness HC (Hv) of foot-bottom central portion: Hv 400 (constant), and surface hardness HE (Hv) of foot-edge portion: Hv 200 to 340

Here, the surface hardness of the foot-bottom central portion is an average value obtained by measuring the surface hardness (hardness of the cross section at depths of 1 mm and 5 mm under the surface) of 20 sites shown in FIG. 7. Further, the surface hardness of the foot-edge portion is an average value obtained by measuring the surface hardness (hardness of the cross section at depths of 1 mm and 5 mm under the surface) of 20 sites shown in FIG. 7. In addition, Hv represents the Vickers hardness.

The surface hardness between the foot-edge portion and the foot-bottom central portion which includes the hardness HM (Hv) of the middle portion between the foot-edge portion and the foot-bottom central portion is in a state of distribution which monotonically increases toward the foot-bottom central portion from the foot-edge portion.

Conditions of Fatigue Test

Test method: 3 point bending of actual rail (span length: 0.65 m) (see FIG. 8)

Load condition: stress range is controlled (maximum load–minimum load, minimum load is 10% of maximum load), frequency of applied load: 5 Hz Test attitude: load is applied to rail head portion (tensile stress is applied to bottom portion)

Figure 2:
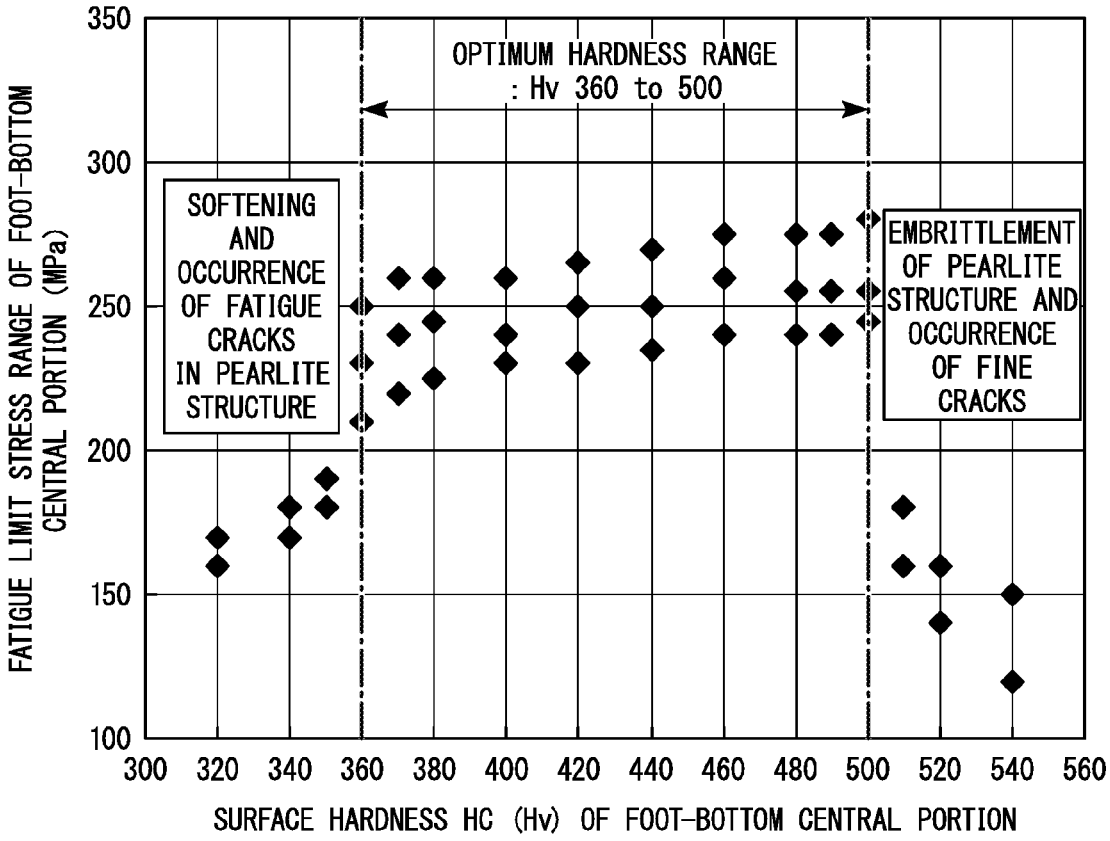
FIG. 2 is a graph showing the relationship between the surface hardness and the fatigue limit stress range of a foot-bottom central portion of a rail.
Figure 3:
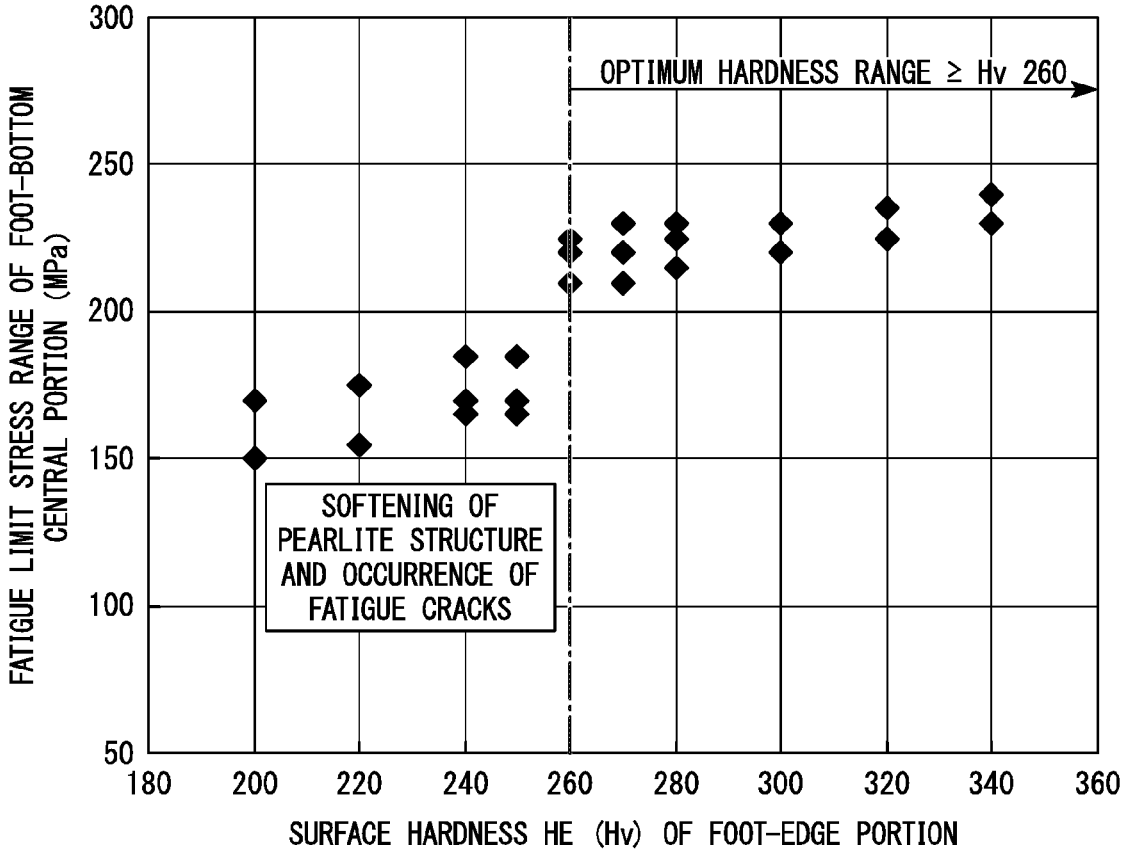
FIG. 3 is a graph showing the relationship between the surface hardness and the fatigue limit stress range of a foot-edge portion of a rail.

Controlling stress: stress is controlled using strain gauge adhering to foot-bottom central portion of rail bottom portion Number of repetition: number of repetition is set to 2 million times and maximum stress range in case of being unfractured is set to fatigue limit stress range FIG. 2 shows fatigue test results of the rails A and FIG. 3 shows fatigue test results of the rails B.

FIG. 2 is a graph organized based on the relationship between the surface hardness HC (Hv) and the fatigue limit stress range of the foot-bottom central portions of the rails A. As understood from the results of FIG. 2, it is understood that the surface hardness HC (Hv) of the foot-bottom central portion is required to be in a range of Hv 360 to 500 in order to ensure the fatigue limit stress range of the load stress (200 MPa) or greater which is assumed to be applied to an actual rail. When HC (Hv) is less than Hv 360, the hardness of pearlite structure is insufficient and fatigue cracks occur. When HC (Hv) is greater than Hv 500, cracks occur due to embrittlement of pearlite structure.

FIG. 3 is a graph organized based on the relationship between the surface hardness HE (Hv) and the fatigue limit stress range of the foot-edge portions of the rails B. As understood from the results of FIG. 3, the surface hardness HE (Hv) of the foot-edge portion is required to be Hv 260 or greater in order to suppress occurrence of fatigue cracks from the foot-edge portion and to ensure the fatigue resistance (fatigue limit stress range of a load stress of 200 MPa or greater) of the rail.

From the test results described above, it is evident that the hardness HC (Hv) of the foot-bottom central portion is controlled to be in a range of Hv 360 to 500 and the surface hardness HE (Hv) of the foot-edge portion is controlled to be Hv 260 or greater in order to improve the fatigue resistance of the rail bottom portion in actual tracks.

Moreover, the hardness suitable for suppressing brittle fracture occurring from the foot-edge portion as the origin is examined by the present inventors. Specifically, a rail in which the hardness of the foot-edge portion is changed is produced by performing hot rolling and a heat treatment on rail steel which has C: 0.75% to 1.20%, 0.50% Si, 0.90% Mn, P: 0.0250% or less, and S: 0.0250% or less and the remainder of Fe and impurities. Further, impact test pieces are machined from the foot-edge portion of the obtained rail to investigate impact characteristics according to an impact test in order to evaluate the breakage resistance.

The test conditions are as follows.

[Impact Test]

Used Rail

Shape: 141 lbs rail (weight: 70 kg/m, width of bottom portion: 152 mm)

Metallographic structure of bottom portion: pearlite

Hardness of foot-edge portion: Hv 240 to 360

Hardness of foot-bottom central portion: Hv 360 to 500

Position of measuring hardness: The surface hardness of the foot-edge portion from the outer surface of the rail bottom portion to sites at depths of 1 mm and 5 mm of the foot-edge portion shown in FIG. 7 is obtained by measuring the surface hardness of 20 sites and averaging the values.

Conditions of Impact Test

Shape of specimen: JIS No. 3, 2 mm U-notch Charpy impact test piece

Figure 9:
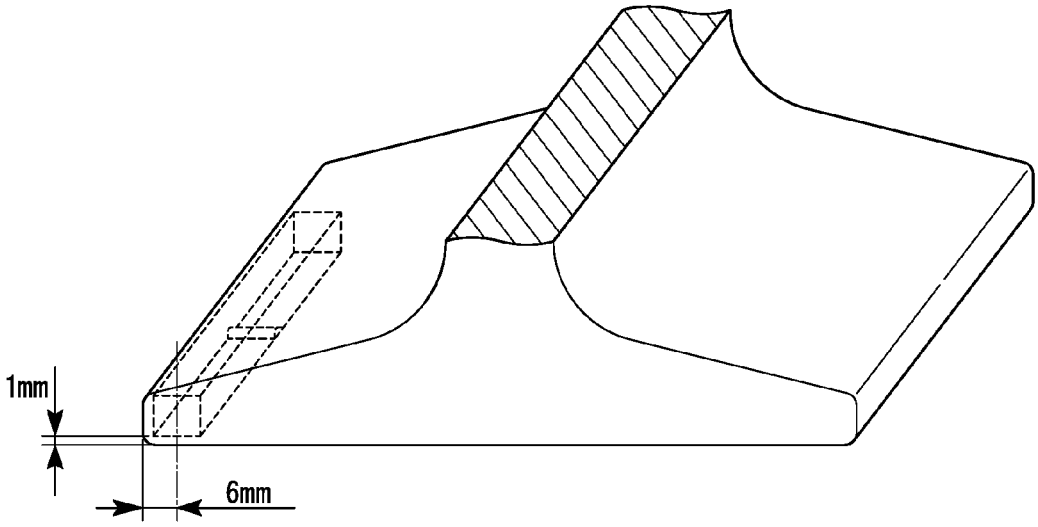
FIG. 9 is a perspective view showing a position of machining impact test samples in a rail.

Position of machining test pieces: foot-edge portion of rail (see FIG. 9)

Test temperature: room temperature (+20° C.)

Test conditions: carried out in conformity with JIS Z2242

Figure 4:
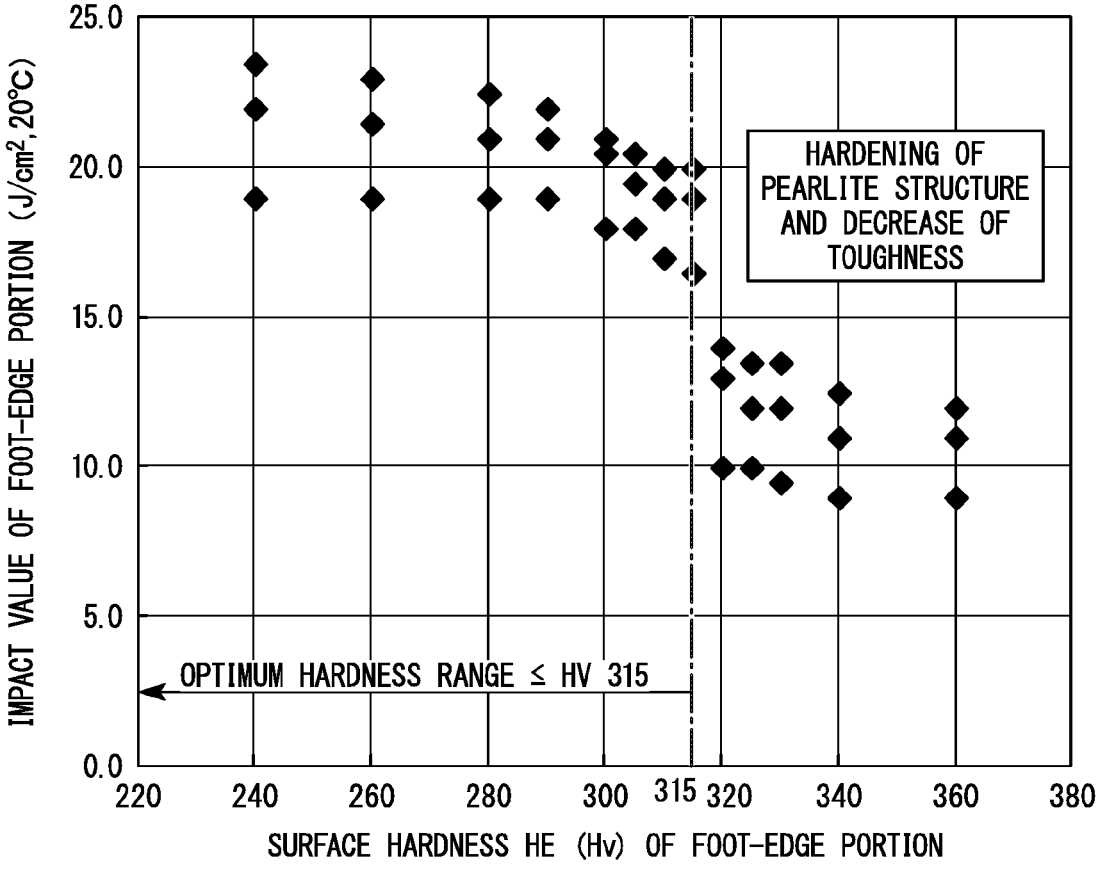
FIG. 4 is a graph showing the relationship between the surface hardness and impact values of the foot-edge portion of a rail.

FIG. 4 shows results of an impact test performed on the foot-edge portion. FIG. 4 is a graph organized based on the relationship between the surface hardness and impact values of the foot-edge portion. As shown in FIG. 4, the impact values tend to increase when the hardness of the foot-edge portion is decreased. It is confirmed that excellent toughness (15.0 J/cm$^2$ or greater at 20° C.) is obtained when the hardness of the foot-edge portion is Hv 315 or less.

From the results described above, in order to improve the breakage resistance and the fatigue resistance of the rail bottom portion by suppressing the brittle fracture occurring from the foot-edge portion and suppressing the fatigue fracture occurring from the foot-edge portion or the foot-bottom central portion, it was found that the surface hardness of the foot-bottom central portion needs to be controlled to be in a range of Hv 360 to 500 and the surface hardness of the foot-edge portion is controlled to be in a range of Hv 260 to 315.

Further, in the rail with the hardness having the above-described range, the relationship between the surface hardness of the middle portion positioned between the foot-bottom central portion and the foot-edge portion and the fatigue resistance of the rail bottom portion is verified by the present inventors. Specifically, a plurality of rails (rails C to E) in which the surface hardness HM (Hv) of the middle portion is changed are produced by performing hot rolling and a heat treatment on rail steel which has 1.00% C, 0.50% Si, 0.90% Mn, P: 0.0250% or less, and S: 0.0250% or less and the remainder of Fe and impurities and by controlling the surface hardness HC (Hv) of the foot-bottom central portion and the surface hardness HE (Hv) of the foot-edge portion to be constant. Further, a fatigue test is performed reproducing the conditions of using actual tracks to the obtained trial rails C to E to investigate the fatigue limit stress range. The test conditions are as follows.

<Actual Rail Bending Fatigue Test (2)>

Used Rail

Shape: 141 lbs rail (weight: 70 kg/m, width of bottom portion: 152 mm)

Metallographic structure of bottom portion: pearlite

Hardness of Rail

Rails C (8 pieces) having middle portion of which hardness is controlled: surface hardness HC (Hv) of foot-bottom central portion: Hv 400 (constant), surface hardness HE (Hv) of foot-edge portion: Hv 315 (constant), and surface hardness HM (Fly) of middle portion positioned between foot-bottom central portion and foot-edge portion: Hv 315 to 400 (HC≥HM≥HE)

Rails D (2 pieces) having middle portion of which hardness is controlled: surface hardness HC (Hv) of foot-bottom central portion: Hv 400 (constant), surface hardness HE (Fly) of foot-edge portion: Hv 315 (constant), and surface hardness HM (Hv) of middle portion positioned between foot-bottom central portion and foot-edge portion: Hv 310 or Hv 290 (HM<HE)

Rails E (2 pieces) having middle portion of which hardness is controlled: surface hardness HC (Hv) of foot-bottom central portion: Hv 400 (constant), surface hardness HE (Hv) of foot-edge portion: Hv 315 (constant), and surface hardness HM (Hv) of middle portion positioned between foot-bottom central portion and foot-edge portion: Hv 405 or Hv 420 (HM>HC)

The surface hardness of the foot-bottom central portion is an average value obtained by measuring the surface hardness (hardness of the cross section at depths of 1 mm and 5 mm under the surface) of 20 sites shown in FIG. 7; the surface hardness of the foot-edge portion is an average value obtained by measuring the surface hardness (hardness of the cross section at depths of 1 mm and 5 mm under the surface) of 20 sites shown in FIG. 7; and the surface hardness of the middle portion is an average value obtained by measuring the surface hardness (hardness of the cross section at depths of 1 mm and 5 mm under the surface) of 20 sites shown in FIG. 7.

The surface hardness between the foot-edge portion and the middle portion and the surface hardness between the middle portion and the foot-bottom central portion are respectively in a state of distribution which monotonically increases or decreases.

Fatigue Test

Test method: 3 point bending of actual rail (span length: 0.65 m) (see FIG. 8)

Load condition: stress range is controlled (maximum load–minimum load, minimum load is 10% of maximum load), frequency of applied load: 5 Hz Test attitude: load is applied to rail head portion (tensile stress is applied to bottom portion)

Controlling stress: stress is controlled using strain gauge adhering to foot-bottom central portion of rail bottom portion Number of repetition: number of repetition is set to 2 million times (maximum stress range in case of being unfractured is set to fatigue limit stress range)

Figure 5:
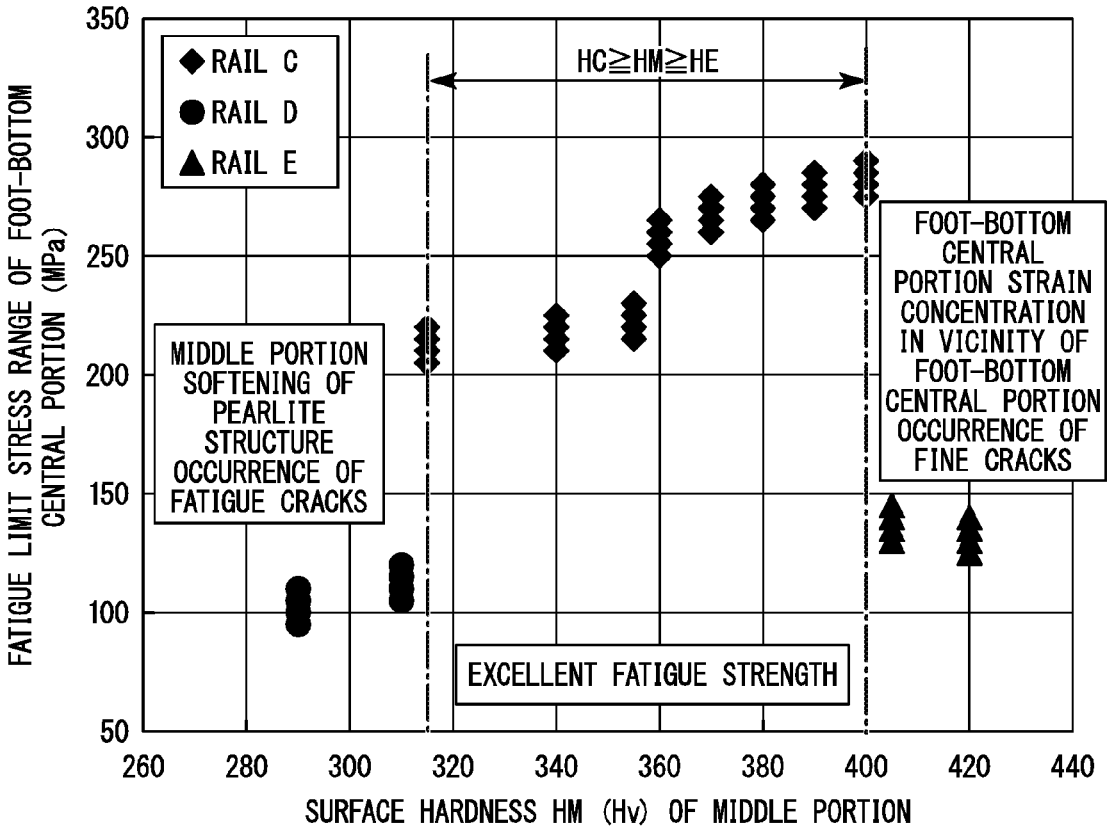
FIG. 5 is a graph showing the relationship between the surface hardness of a middle portion and the fatigue limit stress range of a rail bottom portion of a rail.

FIG. 5 shows the results of the fatigue test performed on the rails C (8 pieces), the rails D (2 pieces), and rails E (2 pieces). FIG. 5 is a graph organized based on the relationship between the surface hardness HM (Hv) of the middle portion and the fatigue limit stress range in the foot-bottom central portion of the bottom portion. In consideration of variation in results, the test is respectively performed on 4 pieces for each rail. As a result, in the rails D that satisfy HM<HE, the strain is concentrated on the middle portion (soft portion) having a surface hardness lower than that of the foot-edge portion and the fatigue fracture occurs from the middle portion. Further, in the rails E that satisfy HM>HC, the strain is concentrated on the boundary portion between the foot-bottom central portion and the middle portion having a surface hardness higher than that of the foot-bottom central portion and the fatigue fracture occurs from the boundary portion. Further, in the rails C, the strain concentration on the middle portion or on the boundary portion between the foot-bottom central portion and the middle portion is suppressed so that the fatigue resistance (load stress of 200 MPa or greater) of the rail bottom portion is ensured.

From the results described above, it was found that the strain concentration on the rail bottom portion needs to be suppressed by controlling the surface hardness HC (Fly) of the foot-bottom central portion, the surface hardness HE (Hv) of the foot-edge portion, and the surface hardness HM (Hv) of the middle portion to satisfy the following Expression 1 in order to improve the fatigue resistance of the rail bottom portion.

$$HC \geq HM \geq HE \qquad \text{Expression 1}$$

The present inventors conducted research by focusing on the balance between the hardness of the foot-bottom central portion and the middle portion in order to further improve the fatigue resistance of the rail bottom portion. Specifically, rails F to H in which the surface hardness HC (Hv) of the foot-bottom central portion and the surface hardness HM (Hv) of the middle portion are changed are produced by performing hot rolling and a heat treatment on rail steel which contains 1.00% C, 0.50% S, 0.90% Mn, P: 0.0250% or less, and S: 0.0250% or less and the remainder of Fe and impurities and by controlling the surface hardness HE (Hv) of the foot-edge portion to be constant. Further, a fatigue test is performed reproducing the conditions of using actual tracks to the obtained trial rails F to H to investigate the fatigue limit stress range. The test conditions are as follows.

<Actual Rail Bending Fatigue Test (3)>

Used Rail

Shape: 141 lbs rail (weight: 70 kg/m, width of bottom portion: 152 mm)

Metallographic structure of bottom portion: pearlite

Hardness of Rail

Rails F (6 pieces) having foot-bottom central portion and middle portion, each of which hardness is controlled: surface hardness HE (Hv) of foot-edge portion: Hv 315 (constant), surface hardness HC (Hv) of foot-bottom central portion: Hv 360, and surface hardness HM (Hv) of middle portion positioned between foot-bottom central portion and foot-edge portion: Hv 315 to 360 (HC≥HM≥HE)

Rails G (8 pieces) having foot-bottom central portion and middle portion, each of which hardness is controlled: surface hardness HE (Hv) of foot-edge portion: Hv 315 (constant), surface hardness HC (Hv) of foot-bottom central portion: Hv 440, and surface hardness HM (Hv) of middle portion positioned between foot-bottom central portion and foot-edge portion: Hv 315 to 440 (HC≥HM≥HE)

Rails H (11 pieces) having foot-bottom central portion and middle portion, each of which hardness is controlled: surface hardness HE (Hv) of foot-edge portion: Hv 315 (constant), surface hardness HC (Hv) of foot-bottom central portion: Hv 500, and surface hardness HM (Hv) of middle portion positioned between foot-bottom central portion and foot-edge portion: Hv 315 to 500 (HC≥HM≥HE)

The surface hardness of the foot-bottom central portion is an average value obtained by measuring the surface hardness (hardness of the cross section at depths of 1 mm and 5 mm under the surface) of 20 sites shown in FIG. 7; the surface hardness of the foot-edge portion is an average value obtained by measuring the surface hardness (hardness of the cross section at depths of 1 mm and 5 mm under the surface) of 20 sites shown in FIG. 7; and the surface hardness of the middle portion is an average value obtained by measuring the surface hardness (hardness of the cross section at depths of 1 mm and 5 mm under the surface) of 20 sites shown in FIG. 7.

The surface hardness between the foot-edge portion and the middle portion and the surface hardness between the middle portion and the foot-bottom central portion are respectively in a state of distribution which monotonically increases or decreases.

Conditions of Fatigue Test

Test method: 3 point bending of actual rail (span length: 0.65 m) (see FIG. 8)

Load condition: stress range is controlled (maximum load–minimum load, minimum load is 10% of maximum load), frequency of applied load: 5 Hz Test attitude: load is applied to rail head portion (tensile stress is applied to bottom portion)

Controlling stress: stress is controlled using strain gauge adhering to foot-bottom central portion of rail bottom portion Number of repetition: number of repetition is set to 2 million times (maximum stress range in case of being unfractured is set to fatigue limit stress range)

Figure 6:
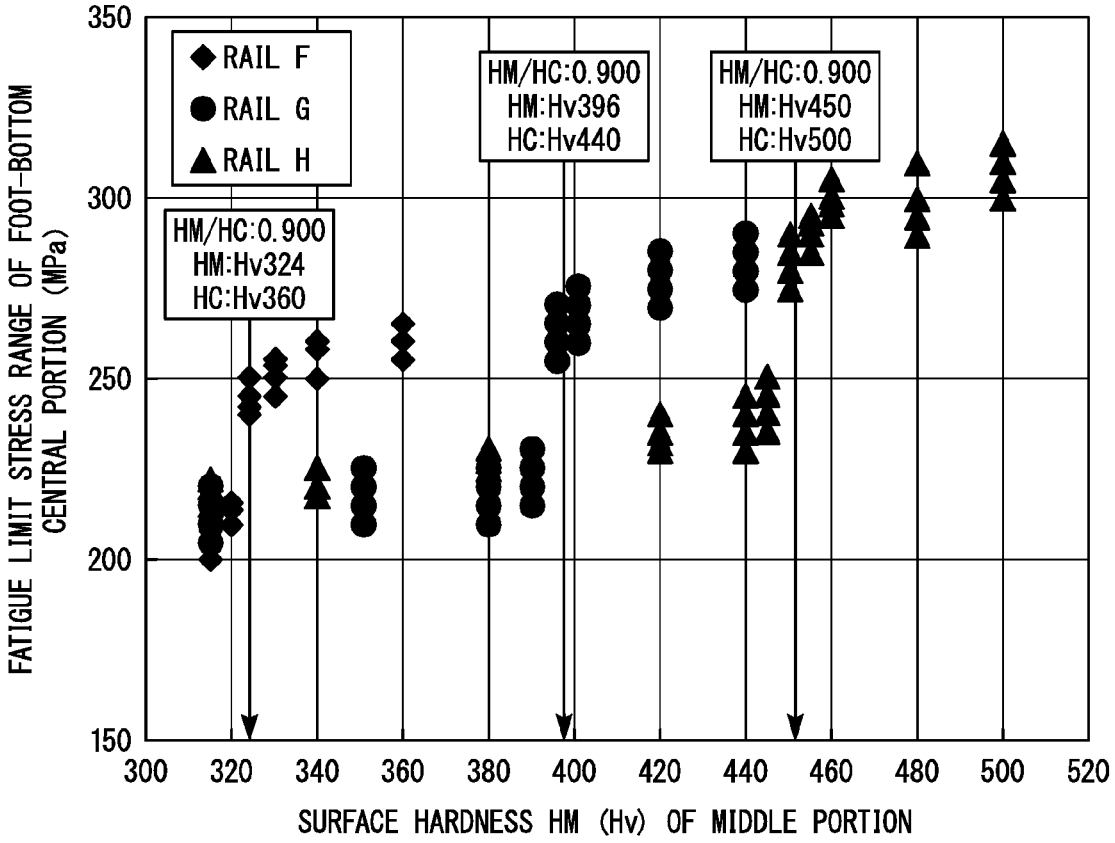
FIG. 6 is a graph showing the relationship between the surface hardness of the foot-bottom central portion and the middle portion and the fatigue limit stress range of a rail bottom portion of a rail.

FIG. 6 shows the results of the fatigue test performed on the rails F (6 pieces), the rails G (8 pieces), and rails H (11 pieces). FIG. 6 is a graph organized based on the relationship between the surface hardness HM (Hv) of the middle portion and the fatigue limit stress range in the bottom portion. In all rails, it was confirmed that the fatigue resistance of the foot-bottom central portion of the rail bottom portion is improved in a region in which the surface hardness HM (Hv) of the middle portion is 0.900 times or greater the surface hardness HC (Hv) of the foot-bottom central portion. The reason for this is considered that the strain concentration on the boundary portion between the foot-bottom central portion and the middle portion is further suppressed due to a decrease of a difference in hardness between the foot-bottom central portion and the middle portion.

From the results described above, it was found that the fatigue stress of the rail bottom portion is further improved by controlling the surface hardness HC (Hv) of the foot-bottom central portion, the surface hardness HE (Hv) of the foot-edge portion, and the surface hardness HM (Hv) of the middle portion to satisfy HC≥HM≥HE, controlling the surface hardness HM (Hv) of the middle portion and the surface hardness HC (Hv) of the foot-bottom central portion to satisfy the following Expression 2, and suppressing the strain concentration on the rail bottom portion.

$$HM/HC \geq 0.900 \qquad \text{Expression 2}$$

Based on the findings described above, the rail according to the present embodiment is a rail used for the purpose of improving breakage resistance and the fatigue resistance of the rail bottom portion used in cargo railways so that the service life is greatly improved by controlling the compositions of rail steel, controlling the metallographic structure of the rail bottom portion and the surface hardness of the foot-bottom central portion and the foot-edge portion of the rail bottom portion, controlling the balance of the surface hardness of the foot-bottom central portion, the foot-edge portion, and the middle portion, and suppressing the strain concentration on the vicinity of the middle portion.

Next, the rail according to the present embodiment will be described in detail. Hereinafter, "%" in the steel composition indicates mass %.

(1) Reason for Limiting Chemical Compositions (Steel Compositions) of Rail Steel The reason for limiting the chemical compositions of steel in the rail according to the present embodiment will be described in detail.

C: 0.75% to 1.20%

C is an element which promotes pearlitic transformation and contributes to improvement of fatigue resistance. However, when the C content is less than 0.75%, the minimum strength and breakage resistance required for the rail cannot be ensured. Further, a large amount of soft pro-eutectoid ferrite in which fatigue cracks easily occur in the rail bottom portion is likely to be generated and fatigue damage is likely to be generated. When the C content is greater than 1.20%, the pro-eutectoid cementite is likely to be generated and fatigue cracks occur from the cementite between the pro-eutectoid cementite and pearlite structure so that the fatigue resistance is degraded. Further, the toughness is degraded and the breakage resistance of the foot-edge portion is degraded. Therefore, the C content is adjusted to be in a range of 0.75% to 1.20% in order to promote generation of pearlite structure and ensure a constant level of fatigue resistance or breakage resistance. It is preferable that the C content is adjusted to be in a range of 0.85% to 1.10% in order to further stabilize generation of pearlite structure and further improve the fatigue resistance or the breakage resistance.

Si: 0.10% to 2.00%

Si is an element which is solid-soluted in ferrite of pearlite structure, increases the hardness (strength) of the rail bottom portion, and improves the fatigue resistance. Further, Si is also an element which suppresses generation of the pro-eutectoid cementite, prevents fatigue damage occurring from the interface between the pro-eutectoid cementite and the pearlite structure, improves the fatigue resistance, suppresses degradation of toughness due to the generation of the pro-eutectoid ferrite, and improves the breakage resistance of the foot-edge portion. However, when the Si content is less than 0.10%, these effects cannot be sufficiently obtained. Meanwhile, when the Si content is greater than 2.00%, a large amount of surface cracks are generated during hot rolling. In addition, hardenability is significantly increased, and martensite structure with low toughness is likely to be generated in the rail bottom portion so that the fatigue resistance is degraded. Further, the hardness is excessively increased and thus the breakage resistance of the foot-edge portion is degraded. Therefore, the Si content is adjusted to be in a range of 0.10% to 2.00% in order to promote generation of pearlite structure and ensure a constant level of fatigue resistance or breakage resistance. It is preferable that the Si content is adjusted to be in a range of 0.20% to 1.50% in order to further stabilize generation of pearlite structure and further improve the fatigue resistance or the breakage resistance.

Mn: 0.10% to 2.00%

Mn is an element which increases the hardenability, stabilizes pearlitic transformation, refines the lamellar spacing of pearlite structure, and ensures the hardness of pearlite structure so that the fatigue resistance is improved. However, when the Mn content is less than 0.10%, the effects thereof are small and a soft pro-eutectoid ferrite in which fatigue cracks easily occur in the rail bottom portion is likely to be generated. When pro-eutectoid ferrite is generated, the fatigue resistance is unlikely to be ensured. Meanwhile, when the Mn content is greater than 2.00%, the hardenability is significantly increased, and martensite structure with low toughness is likely to be generated in the rail bottom portion so that the fatigue resistance is degraded. Further, the hardness is excessively increased and thus the breakage resistance of the foot-edge portion is degraded. Therefore, the Mn addition content is adjusted to be in a range of 0.10% to 2.00% in order to promote generation of pearlite structure and ensure a constant level of fatigue resistance or breakage resistance. It is preferable that the Mn content is adjusted to be in a range of 0.20% to 1.50% in order to further stabilize generation of pearlite structure and further improve the fatigue resistance or the breakage resistance.

P: 0.0250% or Less

P is an element which is unavoidably contained in steel. The amount thereof can be controlled by performing refining in a converter. It is preferable that the P content is small. Particularly, when the P content is greater than 0.0250%, brittle cracks occur from the tip of fatigue cracks in the rail bottom portion so that the fatigue resistance is degraded. Further, the toughness of the foot-edge portion is degraded and the breakage resistance is degraded. Therefore, the P content is limited to 0.0250% or less. The lower limit of the P content is not limited, but the lower limit thereof during actual production is approximately 0.0050% when dephosphrization capacity during the refining process is considered.

S is an element which is unavoidably contained in steel. The content thereof can be controlled by performing desulfurization in a cupola pot. It is preferable that the S content is small. Particularly, when the S content is greater than 0.0250%, pearlite structure is embrittled, inclusions of coarse MnS-based sulfides are likely to be generated, and fatigue cracks occur in the rail bottom portion due to stress concentration on the periphery of the inclusions, and thus the fatigue resistance is degraded. Therefore, the S content is limited to 0.0250% or less. The lower limit of the S content is not limited, but the lower limit thereof during actual production is approximately 0.0030% when desulfurization capacity during the refining process is considered.

Basically, the rail according to the present embodiment contains the above-described chemical compositions and the remainder of Fe and impurities. However, instead of a part of Fe in the remainder, at least one selected from the group consisting of Cr, Mo, Co, B, Cu, Ni, V, Nb, Ti, Mg, Ca, REM, Zr, N, and Al may be further contained, in ranges described below, for the purpose of improving the fatigue resistance due to an increase in hardness (strength) of pearlite structure, improving the toughness, preventing a heat affected zone from being softened, and controlling distribution of the hardness in the cross section in the inside of the rail bottom portion. Specifically, Cr and Mo increase the equilibrium transformation point, refine the lamellar spacing of pearlite structure, and improve the hardness. Co refines the lamellar structure directly beneath the rolling contact surface resulting from the contact with wheels and increases the hardness. B reduces the cooling rate dependence of the pearlitic transformation temperature to make distribution of the hardness in the cross section of the rail bottom portion uniform. Cu is solid-soluted in ferrite of pearlite structure and increases the hardness. Ni improves the toughness and hardness of pearlite structure and prevents the heat affected zone of the weld joint from being softened. V, Nb, and Ti improve the fatigue strength of pearlite structure by precipitation hardening of a carbide and a nitride generated during a hot rolling and a cooling process carried out after the hot rolling. Further, V, Nb, and Ti make a carbide or a nitride be stably generated during re-heating and prevent the heat affected portion of the weld joint from being softened. Mg, Ca, and REM finely disperse MnS-based sulfides, refine austenite grains, promote the pearlitic transformation, and improve the toughness simultaneously. Zr suppresses formation of a segregating zone of a cast slab or bloom central portion and suppresses generation of a pro-eutectoid cementite or the martensite structure by increasing the equiaxed crystal ratio of the solidification structure. N promotes the pearlitic transformation by being segregated in austenite grain boundaries, improves the toughness, and promotes precipitation of a V carbide or a V nitride during a cooling process carried out after hot rolling to improve the fatigue resistance of pearlite structure. Consequently, these elements may be contained in ranges described below in order to obtain the above-described effects. In addition, even if the amount of each element is equal to or smaller than the range described below, the characteristics of the rail according to the present embodiment are not damaged. Further, since these elements are not necessary, the lower limit thereof is 0%.

Cr: 0.01% to 2.00%

Cr is an element which refines the lamellar spacing of pearlite structure and improves the hardness (strength) of pearlite structure so that the fatigue resistance is improved by increasing the equilibrium transformation temperature and increasing the supercooling degree. However, when the Cr content is less than 0.01%, the effects described above are small and the effects of improving the hardness of rail steel cannot be obtained. Meanwhile, when the Cr content is greater than 2.00%, the hardenability is significantly increased, a martensite structure with low toughness is generated in the rail bottom portion, and thus the breakage resistance is degraded. Therefore, it is preferable that the Cr content is set to be in a range of 0.01% to 2.00% when Cr is contained.

Mo: 0.01% to 0.50%

Similar to Cr, Mo is an element which refines the lamellar spacing of pearlite structure and improves the hardness (strength) of pearlite structure so that the fatigue resistance is improved by increasing the equilibrium transformation temperature and increasing the supercooling degree. However, when the Mo content is less than 0.01%, the effects described above are small and the effects of improving the hardness of rail steel cannot be obtained. Meanwhile, when the Mo content is greater than 0.50%, the transformation rate is significantly decreased, the martensite structure with low toughness is generated in the rail bottom portion, and thus the breakage resistance is degraded. Therefore, it is preferable that the Mo content is set to be in a range of 0.01% to 0.50% when Mo is contained.

Co: 0.01% to 1.00%

Co is an element which is solid-soluted in ferrite of pearlite structure, refines the lamellar structure of pearlite structure directly beneath the rolling contact surface resulting from the contact with wheels, and increases the hardness (strength) of pearlite structure so that the fatigue resistance is improved. However, when the Co content is less than 0.01%, the refining of the lamellar structure is not promoted and thus the effects of improving the fatigue resistance cannot be obtained. Meanwhile, when the Co content is greater than 1.00%, the above-described effects are saturated and economic efficiency is decreased due to an increase in alloying addition cost. Therefore, it is preferable that the Co content is set to be in a range of 0.01% to 1.00% when Co is contained.

B: 0.0001% to 0.0050%

B is an element which forms iron borocarbides ($Fe_{23}(CB)_6$) in austenite grain boundaries and reduces cooling rate dependence of the pearlitic transformation temperature by promoting pearlitic transformation. When the cooling rate dependence of the pearlitic transformation temperature is reduced, more uniform distribution of the hardness is imparted to a region from the surface to the inside of the rail bottom portion of the rail and thus the fatigue resistance is improved. However, when the B content is less than 0.0001%, the effects described above are not sufficient and improvement of distribution of the hardness in the rail bottom portion is not recognized. Meanwhile, when B content is greater than 0.0050%, coarse borocarbides are generated and fatigue breakage is likely to occur because of the stress concentration. Therefore, it is preferable that the B content is set to be in a range of 0.0001% to 0.0050% when B is contained.

Cu: 0.01% to 1.00%

Cu is an element which is solid-soluted in ferrite of pearlite structure and improves the hardness (strength) resulting from solid solution strengthening. As a result, the fatigue resistance is improved. However, when the Cu content is less than 0.01%, the effects cannot be obtained. Meanwhile, when the Cu content is greater than 1.00%, martensite structure is generated in the rail bottom portion because of significant improvement of hardenability and thus the breakage resistance is degraded. Therefore, it is preferable that the Cu content is set to be in a range of 0.01% to 1.00% when Cu is contained.

Ni: 0.01% to 1.00%

Ni is an element which improves the toughness of pearlite structure and improves the hardness (strength) resulting from solid solution strengthening. As a result, the fatigue resistance is improved. Further, Ni is an element which is finely precipitated in the heat affected zone as an intermetallic compound of $Ni_3Ti$ in the form of a composite with Ti and suppresses softening due to precipitation strengthening. In addition, Ni is an element which suppresses embrittlement of grain boundaries in steel containing Cu. However, when the Ni content is less than 0.01%, these effects are extremely small. Meanwhile, when the Ni content is greater than 1.00%, martensite structure with low toughness is generated in the rail bottom portion because of significant improvement of hardenability and thus the breakage resistance is degraded. Therefore, it is preferable that the Ni content is set to be in a range of 0.01% to 1.00% when Ni is contained.

V: 0.005% to 0.50%

V is an element which increases the hardness (strength) of pearlite structure using precipitation hardening of a V carbide and a V nitride generated during the cooling process after hot rolling and improves the fatigue resistance. Further, V is an element effective for preventing the heat affected zone of the welded joint from being softened by being generated as a V carbide or a V nitride in a relatively high temperature range, in the heat affected zone re-heated to a temperature range lower than or equal to the Ac1 point. However, when V content is less than 0.005%, these effects cannot be sufficiently obtained and improvement of the hardness (strength) is not recognized. Meanwhile, when V content is greater than 0.50%, precipitation hardening resulting from the V carbide or the V nitride becomes excessive, pearlite structure is embrittled, and then the fatigue resistance of the rail is degraded. Therefore, it is preferable that the V content is set to be in a range of 0.005% to 0.50% when V is contained.

Nb: 0.0010% to 0.050%

Similar to V, Nb is an element which increases the hardness (strength) of pearlite structure using precipitation hardening of a Nb carbide and a Nb nitride generated during the cooling process after hot rolling and improves the fatigue resistance. Further, Nb is an element effective for preventing the heat affected zone of the welded joint from being softened by being stably generated as a Nb carbide or a Nb nitride from a low temperature range to a high temperature range, in the heat affected zone re-heated to a temperature range lower than or equal to the Ac1 point. However, when the Nb content is less than 0.0010%, these effects cannot be sufficiently obtained and improvement of the hardness (strength) of pearlite structure is not recognized. Meanwhile, when Nb content is greater than 0.050%, precipitation hardening resulting from the Nb carbide or the Nb nitride becomes excessive, pearlite structure is embrittled, and then the fatigue resistance of the rail is degraded. Therefore, it is preferable that the Nb content is set to be in a range of 0.0010% to 0.050% when Nb is contained.

Ti: 0.0030% to 0.0500%

Ti is an element which is precipitated as a Ti carbide or a Ti nitride generated during the cooling process after hot rolling, increases the hardness (strength) of pearlite structure using precipitation hardening, and improves the fatigue resistance. Further, Ti is an element effective for preventing the welded joint from being embrittled by attempting refinement of the structure of the heat affected zone heated to the austenite region because the precipitated Ti carbide or Ti nitride is not dissolved at the time of re-heating during welding. However, when the Ti content is less than 0.0030%, these effects are small. Meanwhile, when the Ti content is greater than 0.0500%, a Ti carbide and a Ti nitride which are coarse are generated and fatigue damage is likely to occur due to the stress concentration. Therefore, it is preferable that the Ti content is set to be in a range of 0.0030% to 0.0500% when Ti is contained.

Mg: 0.0005% to 0.0200%

Mg is an element which is bonded to S to form a sulfide (MgS). MgS finely disperses MnS. In addition, the finely dispersed MnS becomes a nucleus of pearlitic transformation so that the pearlitic transformation is promoted and the toughness of pearlite structure is improved. However, when the Mg content is less than 0.0005%, these effects are small. Meanwhile, when the Mg content is greater than 0.0200%, a coarse oxide of Mg is generated and fatigue damage is likely to occur due to the stress concentration. Therefore, it is preferable that the Mg content is set to be in a range of 0.0005% to 0.0200% when Mg is contained.

Ca: 0.0005% to 0.0200%

Ca is an element which has a strong binding force with S and forms a sulfide (CaS). CaS finely disperses MnS. In addition, the finely dispersed MnS becomes a nucleus of pearlitic transformation so that the pearlitic transformation is promoted and the toughness of pearlite structure is improved. However, when the Ca content is less than 0.0005%, these effects are small. Meanwhile, when the Ca content is greater than 0.0200%, a coarse oxide of Ca is generated and fatigue damage is likely to occur due to the stress concentration. Therefore, it is preferable that the Ca content is set to be in a range of 0.0005% to 0.0200% when Ca is contained.

REM: 0.0005% to 0.0500%

REM is a deoxidation and desulfurizing element and is also an element which generates oxysulfide ($REM_2O_2S$) of REM when contained and becomes a nucleus that generates Mn sulfide-based inclusions. Further, since the melting point of the oxysulfide ($REM_2O_2S$) is high as this nucleus, stretching of the Mn sulfide-based inclusions after hot rolling is suppressed. As a result, when REM is contained, MnS is finely dispersed, the stress concentration is relaxed, and the fatigue resistance is improved. However, when the REM content is less than 0.0005%, the effects are small and REM becomes insufficient as the nucleus that generates MnS-based sulfides. Meanwhile, when the REM content is greater than 0.0500%, oxysulfide ($REM_2O_2S$) of full hard REM is generated and fatigue damage is likely to occur due to the stress concentration. Therefore, it is preferable that the REM content is set to be in a range of 0.0005% to 0.0500% when REM is contained.

Here, REM is a rare earth metal such as Ce, La, Pr, or Nd. The content described above is obtained by limiting the total amount of all REM. When the total amount of all REM elements is in the above-described range, the same effects are obtained even when a single element or a combination of elements (two or more kinds) is contained.

Zr: 0.0001% to 0.0200%

Zr is bonded to O and generates a $ZrO_2$ inclusion. Since this $ZrO_2$ inclusion has excellent lattice matching performance with γ-Fe, the $ZrO_2$ inclusion becomes a solidified nucleus of high carbon rail steel in which γ-Fe is a solidified primary phase and suppresses formation of a segregation zone in a central portion of a cast slab or bloom and suppresses generation of martensite structure or pro-eutectoid cementite generated in a segregation portion of the rail by increasing the equiaxed crystal ratio of the solidification structure. However, when the Zr content is less than 0.0001%, the number of $ZrO_2$-based inclusions is small and the inclusions do not sufficiently exhibit effects as solidified nuclei. In this case, martensite structure or pro-eutectoid cementite is likely to be generated in the segregation portion of the rail bottom portion, and accordingly, improvement of the fatigue resistance of the rail cannot be expected. Meanwhile, when the Zr content is greater than 0.0200%, a large amount of coarse Zr-based inclusions are generated and fatigue damage is likely to occur due to the stress concentration. Therefore, it is preferable that the Zr content is set to be in a range of 0.0001% to 0.0200% when Zr is contained.

N: 0.0060% to 0.0200%

N is an element which is effective for improving toughness by promoting pearlitic transformation from austenite grain boundaries by being segregated on the austenite grain boundaries and refining pearlite block size. In addition, N is an element which promotes precipitation of a carbonitride of V during the cooling process after hot rolling, increases the hardness (strength) of pearlite structure, and improves the fatigue resistance when N and V are added simultaneously. However, when the N content is less than 0.0060%, these effects are small. Meanwhile, when the N content is greater than 0.0200%, it becomes difficult for N to be dissolved in steel. In this case, bubbles as the origin of fatigue damage are generated so that the fatigue damage is likely to occur. Therefore, it is preferable that the N content is set to be in a range of 0.0060% to 0.0200% when N is contained.

Al: 0.0100% to 1.00%

Al is an element which functions as a deoxidizer. Further, Al is an element which changes the eutectoid transformation temperature to a high temperature side, contributes to increase the hardness (strength) of pearlite structure, and improves the fatigue resistance. However, when the Al content is less than 0.0100%, the effects thereof are small. Meanwhile, when the Al content is greater than 1.00%, it becomes difficult for Al to be dissolved in steel. In this case, coarse alumina-based inclusions are generated and fatigue cracks occur from the coarse precipitates so that the fatigue damage is likely to occur. Further, an oxide is generated during welding so that the weldability is significantly degraded. Therefore, it is preferable that the Al content is set to be in a range of 0.0100% to 1.00% when Al is contained.

(2) Reason for Limiting Metallographic Structure and Required Regions of Pearlite Structure In the rail according to the present embodiment, the reason for limiting 90% or greater of the area of the metallographic structure at a depth of 5 mm from the outer surface of the bottom portion as the origin to pearlite will be described in detail.

First, the reason for limiting 90% or greater of the area of the metallographic structure to pearlite will be described.

Pearlite is a structure advantageous for improving the fatigue resistance because it is possible to obtain the strength (hardness) by pearlite structure even if the amount of alloy element is low. Further, the strength (hardness) is easily controlled, the toughness is easily improved, and the breakage resistance is excellent. Therefore, for the purpose of improving the breakage resistance and the fatigue resistance of the rail bottom portion, 90% or greater of the area of the metallographic structure is limited to pearlite.

Next, the reason for limiting the required region of pearlite structure to the region at a depth of 5 mm from the outer surface of the bottom portion as the origin will be described.

When the required region of pearlite structure is less than a depth of 5 mm from the outer surface of the bottom portion, the effects for improving the breakage resistance or the fatigue resistance required for the rail bottom portion are small and the rail service life is difficult to sufficiently improve. Therefore, 90% or greater of the area of the metallographic structure at a depth of 5 mm from the outer surface of the bottom portion as the origin is set to pearlite structure.

FIG. 7 shows a region required for pearlite structure. As described above, the rail bottom portion 4 includes the foot-bottom central portion 1, the foot-edge portion 2 positioned on both ends of the foot-bottom central portion 1, and the middle portion 3 positioned between the foot-bottom central portion 1 and the foot-edge portion 2. The outer surface 5 of the rail bottom portion indicates the entire surface of the rail bottom portion 4 including the foot-bottom central portion 1, the middle portion 3, and the foot-edge portion 2 of the rail shown by the bold line and indicates the surface facing down when the rail is upright. In addition, the outer surface 5 of the rail bottom portion may include the side end surfaces of the rail bottom portion.

When pearlite structure is disposed on the surface layer portion of the bottom portion to a depth of 5 mm from the outer surface 5 of the rail bottom portion as the origin, in a region from the foot-bottom central portion 1 to the foot-edge portion 2 on both ends through the middle portion 3, the breakage resistance and the fatigue resistance of the rail are improved. Therefore, as shown in the hatched region in FIG. 7, pearlite P is disposed at least in a region at a depth of 5 mm from the outer surface 5 of the rail bottom portion as the origin for which improvement of the breakage resistance and the fatigue resistance are required. In addition, other portions may be pearlite structure or the metallographic structure other than pearlite structure. Further, in a case where characteristics of the entire cross section of the rail are considered, ensuring of the wear resistance is considered to be the most important particularly in the rail head portion that comes into contact with wheels. As a result of investigation of the relationship between the metallographic structure and the wear resistance, since it was confirmed that pearlite structure is most excellent, it is preferable that the structure of the rail head portion is pearlite.

Moreover, it is preferable that the metallographic structure of the surface layer portion of the rail bottom portion according to the present embodiment is the pearlite as described above, but a small amount of pro-eutectoid ferrite, pro-eutectoid cementite, bainite structure, or martensite structure may be mixed into pearlite structure by 10% or less in terms of the area ratio depending on the chemical composition or a heat treatment production method of the rail. However, even when these structures are mixed into pearlite structure, since the breakage resistance and the fatigue resistance of the rail bottom portion are not greatly affected if the amount thereof is small, the mixture of a small amount of pro-eutectoid ferrite, pro-eutectoid cementite, bainite structure, or martensite structure into pearlite structure by 10% or less in terms of the area ratio is accepted as the rail structure having excellent breakage resistance and fatigue resistance. In other words, 90% or greater of the area ratio of the metallographic structure of the surface layer portion of the rail bottom portion according to the present embodiment may be pearlite. In order to sufficiently improve the breakage resistance and the fatigue resistance, it is preferable that 95% or greater of the area ratio of the metallographic structure of the surface layer portion of the bottom portion is set to be pearlite.

The area ratio is obtained by machining test pieces from the transverse cross section perpendicular to the outer surface of the rail bottom portion, polishing the test pieces, showing the metallographic structure to appear through etching, and observing the metallographic structure at respective positions of 1 mm and 5 mm from the surface. Specifically, in observation at each position described above, the area ratio is obtained by observing the metallographic structure in the visual field of an optical microscope of 200 magnifications and determining the area of each structure. As a result of observation, when both of the area ratios of pearlite structure at positions of a depth of 1 mm and a depth of 5 mm from the surface are 90% or greater, 90% or greater of the metallographic structure at a depth of 5 mm from the outer surface of the rail bottom portion as the origin may be determined to be pearlite structure (the area ratio of pearlite structure at a depth of 5 mm from the outer surface of the rail bottom portion as the origin is 90% or greater). That is, when the area ratio of each position described above is 90%, the middle position interposed by each of the positions may have a pearlite structure area ratio of 90% or greater.

(3) Reason for Limiting Surface Hardness of Foot-Bottom Central Portion

In the rail according to the present embodiment, the reason for limiting the surface hardness of the foot-bottom central portion to a range of Hv 360 to 500 will be described.

When the surface hardness of the foot-bottom central portion is less than Hv 360, the fatigue limit stress range cannot be ensured with respect to the load stress (200 MPa) of the foot-bottom central portion applied to the heavy load railways as shown in FIG. 2 and thus the fatigue resistance of the rail bottom portion is degraded. Meanwhile, when the surface hardness is greater than Hv 500, embrittlement of pearlite structure advances, the fatigue limit stress range cannot be ensured due to occurrence of cracks, and thus fatigue resistance of the rail bottom portion is degraded as shown in FIG. 2. For this reason, the surface hardness of the foot-bottom central portion is limited to a range of Hv 360 to 500.

(4) Reason for Limiting Surface Hardness of Foot-Edge Portion

In the rail according to the present embodiment, the reason for limiting the surface hardness of the foot-edge portion to a range of Hv 260 to 315 will be describe. When the surface hardness of the foot-edge portion is less than Hv 260, the fatigue limit stress range cannot be ensured with respect to the load stress (150 MPa) of the foot-edge portion applied to the heavy load railways as shown in FIG. 3 and thus the fatigue resistance of the rail bottom portion is degraded. Meanwhile, the surface hardness is greater than Hv 315, the toughness of pearlite structure is degraded and the breakage resistance of the rail bottom portion is degraded due to the promotion of brittle fracture as shown in FIG. 4. For this reason, the surface hardness of the foot-edge portion is limited to a range of Hv 260 to 315.

(5) Reason for Limiting Relationship of Surface Hardness HC of Foot-Bottom Central Portion, Surface Hardness HE of Foot-Edge Portion, and Surface Hardness HM of Middle Portion When the surface hardness of the middle portion is set to be smaller than the surface hardness of the foot-edge portion, as shown in FIG. 5, strain is concentrated on the middle portion (soft portion) so that fatigue fracture occurs from the middle portion. Further, when the surface hardness of the middle portion is set to be larger than the surface hardness of the foot-bottom central portion, as shown in FIG. 5, strain is concentrated on the boundary portion between the foot-bottom central portion and the middle portion so that the fatigue fracture occurs from the boundary portion. Therefore, the relationship of the surface hardness HC of the foot-bottom central portion, the surface hardness HE of the foot-edge portion, and the surface hardness HM of the middle portion is limited to satisfy the following conditions.

$$HC \geq HM \geq HE$$

(6) Reason for Limiting Relationship Between Surface Hardness HC of Foot-Bottom Central Portion and Surface Hardness HM of Middle Portion When the surface hardness HC (Hv) of the foot-bottom central portion, the surface hardness HE (Hv) of the foot-edge portion, and the surface hardness HM (Hv) of the middle portion is controlled to be in the above-described relationship (HC≥HM≥HE), the surface hardness HM (Hv) of the middle portion is controlled to be 0.900 times or greater the surface hardness HC (Hv) of the foot-bottom central portion, and a difference in hardness between the foot-bottom central portion and the middle portion, the strain concentration on the boundary portion between the foot-bottom central portion and the middle portion is further suppressed and the fatigue resistance of the rail bottom portion is more improved as shown in FIG. 6. Therefore, the relationship of the surface hardness HC of the foot-bottom central portion and the surface hardness HM of the middle portion is limited to satisfy the following conditions.

$$HM/HC \geq 0.900$$

It is preferable that the surface hardness of the rail bottom portion is measured under the following conditions.

[Method of Measuring Surface Hardness of Rail Bottom Portion]

Measurement

Measuring device: Vickers hardness tester (load of 98 N)

Collection of test pieces for measurement: machining sample out from transverse cross section of bottom portion Pre-processing: polishing transverse cross section with diamond grains having average grain size of 1 μm Measurement method: carried out in conformity with JIS Z2244

Calculation of Hardness

Foot-bottom central portion: Measurement is performed on respectively 20 sites at a depth of 1 mm and a depth of 5 mm under the surface of the site shown in FIG. 7 and the average value thereof is set to the hardness of each position.

Foot-edge portion: Measurement is performed on respectively 20 sites at a depth of 1 mm and a depth of 5 mm under the surface of the site shown in FIG. 7 and the average value thereof is set to the hardness of each position.

Middle portion: Measurement is performed on respectively 20 sites at a depth of 1 mm and a depth of 5 mm under the surface of the site shown in FIG. 7 and the average value thereof is set to the hardness of each position.

Calculation of ratio between surface hardness of middle portion (HM) and surface hardness of foot-bottom central portion (HC).

The ratio between the surface hardness of the middle portion (HM) and the surface hardness of the foot-bottom central portion (HC) is calculated by setting the value obtained by further averaging the average value of each hardness at a depth of 1 mm and a depth of 5 mm under the surface in each site as the surface hardness of the foot-bottom central portion (HC) and the surface hardness of the middle portion (HM).

(7) Method of Controlling Hardness of Rail Bottom Portion

The hardness of the rail bottom portion can be controlled by adjusting the hot rolling conditions and the heat treatment conditions after hot rolling according to the hardness required for the foot-bottom central portion, the foot-edge portion, and the middle portion.

The rail according to the present embodiment can obtain the effects thereof regardless of the production method when the rail includes the above-described compositions, structures, and the like. However, the effects can be obtained by the rail steel having the above-described compositions by performing a smelting in a melting furnace such as a converter or an electric furnace which is typically used, performing an ingot-making and blooming method or a continuous casting method on the molten steel and then hot rolling, and performing a heat treatment in order to control the metallographic structure or the hardness of the rail bottom portion as necessary.

For example, the rail according to the present embodiment is formed in a rail shape by casting molten steel after the compositions are adjusted to obtain a slab or bloom, heating the slab or bloom in a temperature range of 1250° C. to 1300° C., and carrying out hot rolling. Further, the rail can be obtained by performing air cooling or accelerated cooling after hot rolling or performing accelerated cooling after hot rolling, air cooling, and re-heating.

In these series of processes, any one or more of production conditions from among hot rolling conditions, the cooling rate of accelerated cooling after hot rolling, the re-heating temperature after hot rolling, and the cooling rate of accelerated cooling after re-heating subsequent to hot rolling may be controlled in order to adjust the surface hardness of the foot-bottom central portion, the foot-edge portion, and the middle portion.

Preferable Hot Rolling Conditions and Re-heating Conditions

In order to ensure characteristics of the foot-edge portion with a low hardness when compared to the hardness of the foot-bottom central portion, the final hot rolling temperatures of the foot-bottom central portion and the foot-edge portion are individually controlled, for example, the foot-edge portion is cooled before the final hot rolling. As the hot rolling conditions of the actual rail, the hardness of each position can be individually controlled by setting the final hot rolling temperature of the foot-bottom central portion to be in a range of 900° C. to 1000° C. (temperature of the outer surface of the rail bottom portion) and setting the final rolling temperature of the foot-edge portion to be in a range of 800° C. to 900° C. (temperature of the outer surface of the rail bottom portion).

In order to control the hardness of the rail bottom portion for imparting the breakage of the fatigue resistance, it seems enough to control the final hot rolling temperature through caliber rolling of a typical rail. Other rolling conditions of the rail bottom portion may be set such that pearlite structure is mainly obtained according to a known method. For example, with reference to a method described in Japanese Unexamined Patent Application, First Publication No. 2002-226915, rough hot rolling is performed on a slab or bloom, intermediate rolling is performed over a plurality of passes using a reverse mill, the surface of the rail head portion and the central surface of the bottom portion are cooled such that the temperatures thereof are respectively in a range of 50° C. to 100° C. immediately after hot rolling of each pass of intermediate rolling is performed, and then finish hot rolling may be performed two passes or more using a continuous mill. At this time, for the purpose of controlling the hardness of the rail bottom portion, the temperatures of the foot-edge portion and the foot-bottom central portion of the rail bottom portion may be respectively controlled to be in the above-described range before the final hot rolling of the finish rolling.

Moreover, in a case where the rail bottom portion is re-heated after hot rolling, the heating conditions may be controlled to set the heating temperature of the foot-edge portion to be low by comparing to the heating temperature of the foot-bottom central portion in order to decrease the hardness of the foot-edge portion by comparing the hardness of the foot-bottom central portion. As the re-heating conditions of the actual rail, the hardness of the rail bottom portion can be controlled by performing re-heating such that the re-heating temperature of the foot-bottom central portion is in a range of 950° C. to 1050° C. (outer surface of the rail bottom portion) and the re-heating temperature of the foot-edge portion is in a range of 850° C. to 950° C. (outer surface of the rail bottom portion).

In the middle portion, it is preferable that the final hot rolling temperature or the re-heating temperature of a portion in the vicinity of the foot-edge portion is set to be slightly higher than that of the foot-edge portion and the final hot rolling temperature or the re-heating temperature of a portion in the vicinity of the foot-bottom central portion is set to be slightly lower than that of the foot-bottom central portion, based on the conditions in conformity with the hot rolling conditions and the re-heating conditions of the foot-bottom central portion and the foot-edge portion. As a result, the target hardness can be ensured.

Conditions of Accelerated Cooling after Hot Rolling and Re-heating

The method of performing accelerated cooling on the rail bottom portion is not particularly limited. In order to impart the breakage resistance or the fatigue resistance and control the hardness, the cooling rate of the rail bottom portion during the heat treatment may be controlled by means of air injection cooling, mist cooling, mixed injection cooling of water and air, or a combination of these. However, for example, in a case where the accelerated cooling is performed after hot rolling, water or mist is used as a refrigerant for the accelerated cooling of the foot-bottom central portion and air is used as a refrigerant for the accelerated cooling of the foot-edge portion in order to decrease the hardness of the foot-edge portion by comparing to the hardness of the foot-bottom central portion so that the cooling rate of the foot-edge portion is decreased by comparing to the cooling rate of the foot-bottom central portion. Further, the cooling rate and the cooling temperature range are controlled based on the temperature of the outer surface of the rail bottom portion.

In a case where the accelerated cooling is performed after hot rolling, for example, the hardness of each portion can be controlled by performing cooling on the foot-bottom central portion at an accelerated cooling rate of 3° C./sec to 10° C./sec (cooling temperature range: 850° C. to 600° C.) and the foot-edge portion at an accelerated cooling rate of 1° C./sec to 5° C./sec (cooling temperature range: 800° C. to 650° C.). Further, the accelerated cooling may be performed in a temperature range of 800° C. to 600° C. and the cooling conditions of a temperature of lower than 600° C. is not particularly limited.

In a case where the re-heating and then the accelerated cooling are subsequently performed after hot rolling, for example, the hardness of each portion can be controlled by performing cooling on the foot-bottom central portion at an accelerated cooling rate of 5° C./sec to 12° C./sec (cooling temperature range: 850° C. to 600° C.) and the foot-edge portion at an accelerated cooling rate of 3° C./sec to 8° C./sec (cooling temperature range: 800° C. to 600° C.). Further, the accelerated cooling may be performed in a temperature range of 800° C. to 600° C. and the cooling conditions of a temperature of lower than 600° C. is not particularly limited.

In the middle portion, it is preferable that the accelerated cooling rate of a portion in the vicinity of the foot-edge portion is set to be slightly higher than that of the foot-edge portion and the accelerated cooling rate of a portion in the vicinity of the foot-bottom central portion is set to be slightly lower than that of the foot-bottom portion, based on the conditions in conformity with the accelerated cooling conditions of the foot-bottom central portion and the foot-edge portion. As a result, the target hardness can be ensured.

In order to decrease a difference in hardness between the middle portion and the foot-bottom central portion for the purpose of further improving the fatigue resistance, it is preferable that the accelerated cooling rate of the middle portion is set to be close to the cooling rate of the foot-bottom central portion or the temperature of finishing the accelerated cooling is set to be slightly low, specifically, the accelerated cooling is performed to a temperature of around 600° C.

The hardness of the rail bottom portion can be controlled using a combination of the above-described production conditions and the area ratio of pearlite structure can be set to be 90% or greater in the metallographic structure with a predetermined range.

In the production of an actual rail, adjustment within the range of the production conditions described above is necessary according to the composition of rail steel. In the adjustment, the relationship between crystal grains and conditions of hot rolling of steel, equilibrium diagrams of steel, continuous cooling transformation diagrams (CCT diagrams), and the like described in disclosed known documents may be referred to.

When the finish hot rolling temperature is controlled, the hardness of each portion can be differentiated and the structure can be determined by selecting the hot rolling temperature of the foot-edge portion, the foot-bottom central portion, or the middle portion based on the relationship between the conditions of hot rolling and the austenite grain size. As a specific example, in the foot-edge portion expected to decrease the hardness thereof, the austenite grain size can be reduced (grain size number is increased) by decreasing the rolling temperature. Further, delay before hot rolling or forced cooling of the foot-edge portion can be applied to a decrease in hot rolling temperature of the foot-edge portion.

Further, when the re-heating temperature is controlled, the re-heating temperature can be selected from the equilibrium state diagram of iron carbon. As a specific example, the austenite grain size is reduced by decreasing the re-heating temperature in the foot-edge portion expected to decrease the hardness thereof. In addition, when the temperature is extremely decreased, the metallographic structure is not completely austenitized in some cases. For this reason, it is preferable that the minimum heating temperature is controlled using the A1 line, A3 line, and A cm line as the base. In order to set the re-heating temperature of the foot-edge portion to be low, suppression of heating such as installation of a shielding plate or the like can be applied in a case of re-heating with radiation heat. In a case of using induction heating, the heating of the foot-edge portion is suppressed by adjusting the arrangement of a plurality of coils or the heating of the foot-edge portion is suppressed by adjusting the output of induction heating coils in the vicinity of the foot-edge portion.

When the cooling rate of the accelerated cooling is controlled (cooling carried out as the heat treatment after the finish rolling or the re-heating is controlled), the accelerated cooling rate can be determined from the CCT diagrams according to the composition of the rail steel. Specifically, in order to ensure generation of pearlite structure, it is preferable that an appropriate cooling rate of pearlite transformation is derived from the CCT diagrams and the cooling rate is controlled such that the target hardness can be obtained from the range. As a specific example, it is necessary to control the cooling rate to be low in the foot-edge portion expected to decrease the hardness thereof by comparing to the cooling rate of the foot-bottom central portion.

The rail according to the present embodiment can be produced by using the above-described microstructure control method in combination with new knowledge obtained by the present inventors.

EXAMPLES

Next, examples of the present invention will be described.

Tables 1 to 4 show the chemical compositions and characteristics of rails in examples of the present invention. Tables 1 to 4 show the values of chemical composition, the microstructure of the bottom portion, the surface hardness of the bottom portion, and the ratio between the surface hardness of the foot-bottom central portion and the surface hardness of the middle portion. The remainder of the chemical compositions is Fe and impurities. The results of the fatigue test performed according to the method shown in FIG. 8 and the results of the impact test performed on the foot-edge portion by machining test pieces from the position shown in FIG. 9 are also listed. In a case where only "pearlite" is described, the area ratio of pearlite structure at a depth of 5 mm from the outer surface of the rail bottom portion as the origin is 90% or greater and the microstructure of the bottom portion includes a small amount of at least one of pro-eutectoid ferrite, pro-eutectoid cementite, bainite structure, and martensite structure, mixed into pearlite structure, by 10% or less in terms of the area ratio.

Further, Tables 5 to 9 show the values of chemical composition, the microstructure of the bottom portion, the surface hardness of the bottom portion, and the ratio between the surface hardness of the foot-bottom central portion and the surface hardness of the middle portion of rails in the comparative examples. Further, the results of the fatigue test performed according to the method shown in FIG. 8 and the results of the impact test performed on the foot-edge portion by machining test pieces from the position shown in FIG. 9 are also listed. In a case where only "pearlite" is described, the area ratio of pearlite structure at a depth of 5 mm from the outer surface of the rail bottom portion as the origin is 90% or greater and the microstructure of the bottom portion includes a small amount of at least one of pro-eutectoid ferrite, pro-eutectoid cementite, bainite structure, and martensite structure, mixed into pearlite structure, by 10% or less in terms of the area ratio. In addition, when a structure other than pearlite is described in the columns of the microstructure, the area ratio is greater than 10% based on the entire area ratio. For example, in a case where there is a description of "pearlite+pro-eutectoid ferrite", the area ratio of pearlite structure is less than 90% and the main structure of the remainder is pro-eutectoid ferrite.

The outline of the production process and the production conditions of rails of the present invention and rails for comparison listed in Tables 1 to 4 and Tables 5 to 9 will be described below in two ways.

[Process of Producing Rails of Present Invention]

Rails of present invention are produced in the following order:

(1) melting steel;
(2) composition adjustment;
(3) casting (bloom);
(4) re-heating (1250° C. to 1300° C.);
(5) hot rolling; and
(6) air cooling or heat treatment (accelerated cooling).

Other rails of present invention are produced in the following order:

(1) melting steel;
(2) composition adjustment;
(3) casting;
(4) re-heating;
(5) hot rolling;
(6) air cooling;
(7) re-heating (rail); and
(8) heat treatment (accelerated cooling).

Further, the outline of the conditions for producing the rails of the present invention listed in Tables 1 to 4 is as follows. In conditions for producing rails for comparison in Tables 5 to 9, the rails of Comparative Examples 1 to 8 were produced within the range of the conditions for producing the rails of the present invention. Further, in conditions for producing rails of Comparative Examples 9 to 20, the rails were produced under conditions, some of which were outside of the conditions for producing the rails of the present invention.

[Conditions for Producing Rails of Present Invention]

Hot Rolling Conditions (Only Examples to which Conditions were Applied)

Final hot rolling temperature of foot-bottom central portion: 900° C. to 1000° C.

Final hot rolling temperature of foot-edge portion: 800° C. to 900° C.

Re-heating Conditions (Only Examples to which Conditions were Applied)

Re-heating temperature of foot-bottom central portion: 950° C. to 1050° C.

Re-heating temperature of foot-edge portion: 850° C. to 950° C.

Conditions for Heat Treatment Performed on Bottom Portion (Only Examples to which Conditions were Applied)

Heat treatment cooling rate immediately after hot rolling

Foot-bottom central portion: 3° C./sec to 10° C./sec (cooling temperature range: 850° C. to 600° C.)

Foot-edge portion: 1° C./sec to 5° C./sec (cooling temperature range: 800° C. to 600° C.)

Heat Treatment Cooling Rate Immediately after Reheating

Foot-bottom central portion: 5° C./sec to 12° C./sec (cooling temperature range: 850° C. to 600° C.)

Foot-edge portion: 3° C./sec to 8° C./sec (cooling temperature range: 800° C. to 650° C.)

Further, the details of the rails of the present invention and the rails for comparison respectively listed in Tables 1 to 4 and Tables 5 to 9 are as follows.

(1) Rails of Present Invention (35 Pieces)

Examples 1 to 35 of present invention: Rails in which the values of the chemical compositions, the microstructure of the bottom portion, the surface hardness of the bottom portion (foot-bottom central portion and foot-edge portion), and the ratio between the surface hardness of the foot-bottom central portion and the surface hardness of the middle portion were in the ranges of the invention of the present application.

(2) Rails for Comparison (20 Pieces)

Comparative Examples 1 to 8 (8 Pieces)

Rails in which any of the contents of C, Si, Mn, P, and S and the microstructure of the bottom portion was out of the range of the invention of the present application.

Comparative Examples 9 to 20 (12 Pieces)

Rails in which the foot-bottom central portion of the rail bottom portion, the surface hardness of the foot-edge portion, and the balance of the surface hardnesses of the foot-bottom central portion, the foot-edge portion, and the middle portion were out of the ranges of the invention of the present application.

In addition, conditions for various tests are as follows.

[Actual Rail Bending Fatigue Test (See FIG. 8)]

Test method: 3 point bending of actual rail (span length: 0.65 m, frequency: 5 Hz)

Load condition: stress range was controlled (maximum load−minimum load, minimum load was 10% of maximum load)

Test attitude: load was applied to rail head portion (tensile stress was applied to bottom portion)

Controlling stress: stress was controlled using strain gauge adhering to foot-bottom central portion of rail bottom portion Number of repetition: 2 million times, maximum stress range in case of being unfractured was set to fatigue limit stress range

[Impact Test]

Shape of specimen: JIS No. 3, 2 mm U-notch Charpy impact test piece

Position of machining test pieces: foot-edge portion of rail (see FIG. 9)

Test temperature: room temperature (+20° C.)

[Method of Measuring Surface Hardness of Rail Bottom Portion]

Measurement

Measuring device: Vickers hardness tester (load of 98 N)

Collection of test pieces for measurement: machining sample out from transverse cross section of bottom portion Pre-processing: polishing transverse cross section with diamond grains having average grain size of 1 μm Measurement method: carried out in conformity with JIS Z2244

Method of Calculating Hardness

Surface hardness of foot-bottom central portion: Measurement was performed on respectively 20 sites at a depth of 1 mm and a depth of 5 mm under the surface of the site shown in FIG. 7 and the average value thereof was set to the hardness of each position.

Surface hardness of foot-edge portion: Measurement was performed on respectively 20 sites at a depth of 1 mm and a depth of 5 mm under the surface of the site shown in FIG. 7 and the average value thereof was set to the hardness of each position.

Surface hardness of middle portion: Measurement was performed on respectively 20 sites at a depth of 1 mm and a depth of 5 mm under the surface of the site shown in FIG. 7 and the average value thereof was set to the hardness of each position.

Method of calculating ratio between surface hardness (HM) of middle portion and surface hardness (HC) of foot-bottom central portion The ratio between the surface hardness (HM) of the middle portion and the surface hardness (HC) of the foot-bottom central portion was calculated by setting the value obtained by further averaging the average value of each hardness at a depth of 1 mm and a depth of 5 mm under the surface in each site as the surface hardness (HC) of the foot-bottom central portion and the surface hardness (HM) of the middle portion.

As shown in Tables 1 to 4 and Tables 5 to 9, in the rails of the present invention (Examples 1 to 35) compared to the rails for comparison (Comparative Examples 1 to 8), the fatigue strength of the foot-bottom central portion and the toughness of the foot-edge portion were improved and the breakage resistance and the fatigue resistance of rails were improved by setting the contents of C, Si, Mn, P, and S of steel to be in the limited ranges, suppressing generation of pro-eutectoid ferrite, pro-eutectoid cementite, bainite structure, or marutensite structure, controlling the inclusions or the toughness of pearlite structure, and controlling the surface hardness of the foot-bottom central portion and the foot-edge portion of the rail bottom portion.

In addition, in the rails of the present invention (Examples 1 to 35) compared to the rails for comparison (Comparative Examples 9 to 20), the fatigue resistance was improved by controlling the balance of the surface hardness of the foot-bottom central portion and the foot-edge portion of the rail bottom portion and the surface hardness of the middle portion.

Figure 10:
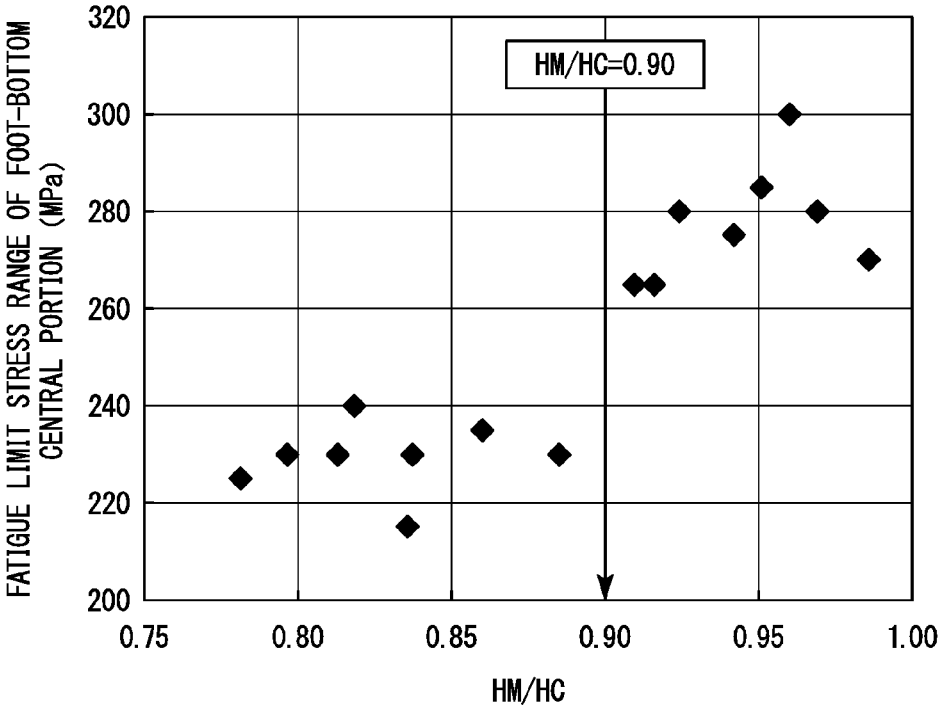
FIG. 10 is a view showing the relationship between the ratio of the surface hardness HM (Hv) of the middle portion to the surface hardness HC (Hv) of the foot-bottom central portion and the fatigue limit stress of a rail.

Further, as shown in Tables 1 to 4 and FIG. 10, the fatigue resistance of the rails of the present invention (Examples 9, 10, 12, 13, 15, 16, 18, 19, 20, 21, 23, 24, 25, 26, 29, 30, 32, and 33) was further improved by controlling the surface hardness HC (Hv) of the foot bottom central portion of the rail bottom portion and the surface hardness (HM) (Hv) of the middle portion to satisfy the expression of HM/HC≥0.900 and further controlling the balance of the surface hardness.

TABLE 1

| Example of | Chemical composition (mass %) | | | | | | | | | | | | | | | | | | | |
|---|---|---|---|---|---|---|---|---|---|---|---|---|---|---|---|---|---|---|---|---|
| invention | C | Si | Mn | P | S | Cr | Mo | Co | B | Cu | Ni | V | Nb | Ti | Mg | Ca | REM | Zr | N | Al |
| 1 | 0.75 | 0.25 | 1.00 | 0.0150 | 0.0120 | 0.00 | — | — | — | — | — | — | — | — | — | — | — | — | — | — |
| 2 | 1.20 | 0.25 | 1.00 | 0.0150 | 0.0120 | 0.00 | — | — | — | — | — | — | — | — | — | — | — | — | — | — |
| 3 | 0.80 | 0.10 | 0.80 | 0.0180 | 0.0100 | 0.00 | — | — | — | — | — | — | — | — | — | — | — | — | — | — |
| 4 | 0.80 | 2.00 | 0.80 | 0.0180 | 0.0100 | 0.00 | — | — | — | — | — | — | — | — | — | — | — | — | — | — |
| 5 | 0.90 | 0.45 | 0.10 | 0.0120 | 0.0080 | 0.00 | — | — | — | — | — | — | — | — | — | — | — | — | — | — |
| 6 | 0.90 | 0.45 | 2.00 | 0.0120 | 0.0080 | 0.00 | — | — | — | — | — | — | — | — | — | — | — | — | — | — |
| 7 | 1.00 | 0.75 | 0.75 | 0.0250 | 0.0100 | 0.00 | — | — | — | — | — | — | — | — | — | — | — | — | — | — |
| 8 | 1.10 | 0.65 | 0.55 | 0.0120 | 0.0250 | 0.00 | — | — | — | — | — | — | — | — | — | — | — | — | — | — |
| 9 | 0.76 | 0.35 | 0.85 | 0.0140 | 0.0130 | 0.22 | — | — | — | — | — | — | — | — | — | — | — | — | — | — |
| 10 | 0.76 | 0.35 | 0.85 | 0.0140 | 0.0130 | 0.22 | — | — | — | — | — | — | — | — | — | — | — | — | — | — |
| 11 | 0.77 | 0.60 | 0.75 | 0.0200 | 0.0200 | 0.00 | — | — | — | 0.20 | — | — | — | — | — | — | — | — | — | — |
| 12 | 0.80 | 0.35 | 0.85 | 0.0190 | 0.0150 | 0.17 | — | — | — | — | — | 0.025 | — | — | — | — | — | — | — | — |
| 13 | 0.80 | 0.35 | 0.85 | 0.0190 | 0.0150 | 0.17 | — | — | — | — | — | 0.025 | — | — | — | — | — | — | — | — |
| 14 | 0.80 | 1.60 | 0.25 | 0.0150 | 0.0180 | 0.00 | — | — | — | — | 0.15 | — | — | — | — | — | — | — | — | — |
| 15 | 0.80 | 0.50 | 1.35 | 0.0070 | 0.0150 | 0.00 | — | — | — | — | — | — | — | — | — | — | — | — | — | — |
| 16 | 0.80 | 0.50 | 1.35 | 0.0070 | 0.0150 | 0.00 | — | — | — | — | — | — | — | — | — | — | — | — | — | — |
| 17 | 0.86 | 0.35 | 1.15 | 0.0200 | 0.0240 | 0.00 | — | 0.10 | — | — | — | — | — | — | — | — | — | — | — | — |

TABLE 2

| Example of | Chemical composition (mass %) | | | | | | | | | | |
|---|---|---|---|---|---|---|---|---|---|---|---|
| invention | C | Si | Mn | P | S | Cr | Mo | Co | B | Cu | Ni |
| 18 | 0.90 | 0.40 | 0.65 | 0.0120 | 0.0180 | 0.65 | — | — | — | — | — |
| 19 | 0.90 | 0.40 | 0.65 | 0.0120 | 0.0180 | 0.65 | — | — | — | — | — |
| 20 | 0.90 | 0.50 | 1.10 | 0.0150 | 0.0120 | 0.00 | — | — | — | — | — |
| 21 | 0.90 | 0.50 | 1.10 | 0.0150 | 0.0120 | 0.00 | — | — | — | — | — |
| 22 | 0.96 | 0.85 | 0.85 | 0.0120 | 0.0120 | 0.00 | 0.01 | — | — | — | — |
| 23 | 1.00 | 0.85 | 0.65 | 0.0150 | 0.0245 | 0.00 | — | — | — | — | — |
| 24 | 1.00 | 0.85 | 0.65 | 0.0150 | 0.0245 | 0.00 | — | — | — | — | — |
| 25 | 1.00 | 0.45 | 1.00 | 0.0135 | 0.0090 | 0.21 | — | — | — | — | — |
| 26 | 1.00 | 0.45 | 1.00 | 0.0135 | 0.0090 | 0.21 | — | — | — | — | — |
| 27 | 1.04 | 0.25 | 1.15 | 0.0050 | 0.0100 | 0.00 | — | — | 0.0009 | — | — |
| 28 | 1.04 | 0.85 | 0.75 | 0.0190 | 0.0110 | 0.00 | — | — | — | — | — |
| 29 | 1.05 | 0.25 | 1.15 | 0.0150 | 0.0070 | 0.00 | — | — | — | — | — |

TABLE 2-continued

| | | | | | | | | | | | |
|---|---|---|---|---|---|---|---|---|---|---|---|
| 30 | 1.05 | 0.25 | 1.15 | 0.0150 | 0.0070 | 0.00 | — | — | — | — | — |
| 31 | 1.06 | 0.65 | 0.85 | 0.0150 | 0.0030 | 0.00 | — | — | — | — | — |
| 32 | 1.10 | 0.45 | 0.35 | 0.0080 | 0.0080 | 0.00 | — | — | — | — | — |
| 33 | 1.10 | 0.45 | 0.35 | 0.0080 | 0.0080 | 0.00 | — | — | — | — | — |
| 34 | 1.15 | 0.50 | 0.85 | 0.0180 | 0.0090 | 0.00 | — | — | — | — | — |
| 35 | 1.20 | 0.80 | 0.65 | 0.0150 | 0.0050 | 0.00 | — | — | — | — | — |

| Example of | Chemical composition (mass %) | | | | | | | | |
|---|---|---|---|---|---|---|---|---|---|
| invention | V | Nb | Ti | Mg | Ca | REM | Zr | N | Al |
| 18 | — | — | — | — | — | — | — | — | — |
| 19 | — | — | — | — | — | — | — | — | — |
| 20 | — | — | — | — | — | — | — | — | — |
| 21 | — | — | — | — | — | — | — | — | — |
| 22 | — | — | — | — | — | — | — | — | — |
| 23 | — | 0.0025 | 0.0050 | — | — | — | — | — | — |
| 24 | — | 0.0025 | 0.0050 | — | — | — | — | — | — |
| 25 | — | — | — | — | — | — | — | — | — |
| 26 | — | — | — | — | — | — | — | — | — |
| 27 | — | — | — | — | — | — | — | — | — |
| 28 | — | — | — | 0.0025 | 0.0015 | — | — | — | — |
| 29 | 0.050 | — | — | — | — | — | — | 0.011 | — |
| 30 | 0.050 | — | — | — | — | — | — | 0.011 | — |
| 31 | — | — | — | — | — | 0.0025 | — | — | — |
| 32 | — | — | — | — | — | — | — | — | — |
| 33 | — | — | — | — | — | — | — | — | — |
| 34 | — | — | — | — | — | — | 0.0025 | — | — |
| 35 | — | — | — | — | — | — | — | — | 0.0200 |

TABLE 3

| Example of invention | Position for observing microstructure and measuring hardness | Microstructure of bottom portion: Foot-bottom central portion | Microstructure of bottom portion: Foot-edge portion | Microstructure of bottom portion: Middle portion | Surface hardness of bottom portion: Foot-bottom central portion HC (Hv) | Surface hardness of bottom portion: Foot-edge portion HE (Hv) | Surface hardness of bottom portion: Middle portion HM (Hv) | Ratio between surface hardness of foot-bottom central portion and surface hardness of middle portion (HM/HC) | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|---|---|---|---|---|---|---|---|
| 1 | Depth of 1 mm under surface | Pearlite | Pearlite | Pearlite | 380 | 260 | 300 | 0801 | 215 | 22.0 | Performing heat treatment after hot rolling | Lower limit of C |
| | Depth of 5 mm under surface | Pearlite | Pearlite | Pearlite | 375 | 260 | 305 | | | | Controlling cooling rate | |
| 2 | Depth of 1 mm under surface | Pearlite | Pearlite | Pearlite | 460 | 280 | 350 | 0.781 | 230 | 17.0 | Performing heat treatment after hot rolling | Upper limit of C |
| | Depth of 5 mm under surface | Pearlite | Pearlite | Pearlite | 456 | 275 | 365 | | | | Controlling cooling rate | |
| 3 | Depth of 1 mm under surface | Pearlite | Pearlite | Pearlite | 400 | 285 | 325 | 0.824 | 220 | 21.0 | Performing re-heat treatment after hot rolling | Lower limit of Si |
| | Depth of 5 mm under surface | Pearlite | Pearlite | Pearlite | 395 | 280 | 330 | | | | Controlling cooling rate | |
| 4 | Depth of 1 mm under surface | Pearlite | Pearlite | Pearlite | 410 | 280 | 380 | 0.944 | 260 | 20.5 | Performing re-heat treatment after hot rolling | Upper limit of Si |
| | Depth of 5 mm under surface | Pearlite | Pearlite | Pearlite | 400 | 275 | 385 | | | | Controlling cooling rate | |
| 5 | Depth of 1 mm under surface | Pearlite | Pearlite | Pearlite | 365 | 260 | 325 | 0.898 | 220 | 21.0 | Controlling re-heating temperature | Lower limit of Mn |
| | Depth of 5 mm under surface | Pearlite | Pearlite | Pearlite | 364 | 260 | 330 | | | | | |
| 6 | Depth of 1 mm under surface | Pearlite | Pearlite | Pearlite | 450 | 300 | 395 | 0.898 | 230 | 18.0 | Controlling re-heating temperature | Upper limit of Mn |
| | Depth of 5 mm under surface | Pearlite | Pearlite | Pearlite | 435 | 290 | 400 | | | | | |
| 7 | Depth of 1 mm under surface | Pearlite | Pearlite | Pearlite | 430 | 295 | 385 | 0.894 | 225 | 16.5 | Controlling finish hot rolling temperature | Upper limit of P |
| | Depth of 5 mm under surface | Pearlite | Pearlite | Pearlite | 420 | 290 | 375 | | | | | |
| 8 | Depth of 1 mm under surface | Pearlite | Pearlite | Pearlite | 430 | 305 | 395 | 0.918 | 265 | 16.5 | Controlling finish hot rolling temperature | Upper limit of S |
| | Depth of 5 mm under surface | Pearlite | Pearlite | Pearlite | 425 | 295 | 390 | | | | | |
| 9 | Depth of 1 mm under surface | Pearlite | Pearlite | Pearlite | 370 | 260 | 310 | 0.836 | 215 | 24.0 | Performing heat treatment after hot rolling | Addition of Cr |
| | Depth of 5 mm under surface | Pearlite | Pearlite | Pearlite | 360 | 260 | 300 | | | | Controlling cooling rate | |

TABLE 3-continued

| Example of invention | Position for observing microstructure and measuring hardness | Microstructure of bottom portion: Foot-bottom central portion | Microstructure of bottom portion: Foot-edge portion | Microstructure of bottom portion: Middle portion | Surface hardness of bottom portion: Foot-bottom central portion HC (Hv) | Surface hardness of bottom portion: Foot-edge portion HE (Hv) | Surface hardness of bottom portion: Middle portion HM (Hv) | Ratio between surface hardness of foot-bottom central portion and surface hardness of middle portion (HM/HC) | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|---|---|---|---|---|---|---|---|
| 10 | Depth of 1 mm under surface | Pearlite | Pearlite | Pearlite | 370 | 260 | 360 | 0.986 | 270 | 24.0 | Controlling finish hot rolling temperature + performing heat treatment and cooling after hot rolling | Addition of Cr |
| | Depth of 5 mm under surface | Pearlite | Pearlite | Pearlite | 360 | 260 | 360 | | | | | |
| 11 | Depth of 1 mm under surface | Pearlite | Pearlite | Pearlite | 360 | 290 | 320 | 0.882 | 215 | 21.5 | Controlling finish hot rolling temperature + performing heat treatment and cooling after hot rolling | Addition of Cu |
| | Depth of 5 mm under surface | Pearlite | Pearlite | Pearlite | 360 | 280 | 315 | | | | | |
| 12 | Depth of 1 mm under surface | Pearlite | Pearlite | Pearlite | 420 | 300 | 335 | 0.796 | 230 | 20.0 | Controlling finish hot rolling temperature | Addition of Cr + V |
| | Depth of 5 mm under surface | Pearlite | Pearlite | Pearlite | 415 | 295 | 330 | | | | | |
| 13 | Depth of 1 mm under surface | Pearlite | Pearlite | Pearlite | 420 | 300 | 385 | 0.916 | 265 | 20.0 | Controlling finish hot rolling temperature + performing heat treatment and cooling after hot rolling | Addition of Cr + V |
| | Depth of 5 mm under surface | Pearlite | Pearlite | Pearlite | 415 | 295 | 380 | | | | | |
| 14 | Depth of 1 mm under surface | Pearlite | Pearlite | Pearlite | 380 | 265 | 325 | 0.860 | 220 | 22.0 | Controlling re-heating temperature | Addition of Ni |
| | Depth of 5 mm under surface | Pearlite | Pearlite | Pearlite | 370 | 260 | 320 | | | | | |
| 15 | Depth of 1 mm under surface | Pearlite | Pearlite | Pearlite | 430 | 290 | 350 | 0.813 | 230 | 21.0 | Controlling finish hot rolling temperature | None |
| | Depth of 5 mm under surface | Pearlite | Pearlite | Pearlite | 425 | 285 | 345 | | | | | |
| 16 | Depth of 1 mm under surface | Pearlite | Pearlite | Pearlite | 430 | 290 | 405 | 0.942 | 275 | 21.0 | Controlling finish hot rolling temperature + performing heat treatment and cooling after hot rolling | None |
| | Depth of 5 mm under surface | Pearlite | Pearlite | Pearlite | 425 | 285 | 400 | | | | | |
| 17 | Depth of 1 mm under surface | Pearlite | Pearlite | Pearlite | 445 | 300 | 420 | 0.944 | 285 | 19.0 | Controlling finish hot rolling temperature | Addition of Co |
| | Depth of 5 mm under surface | Pearlite | Pearlite | Pearlite | 440 | 295 | 415 | | | | | |

TABLE 4

| Example of invention | Position for observing microstructure and measuring hardness | Microstructure of bottom portion: Foot-bottom central portion | Microstructure of bottom portion: Foot-edge portion | Microstructure of bottom portion: Middle portion | Surface hardness of bottom portion: Foot-bottom central portion HC (Hv) | Surface hardness of bottom portion: Foot-edge portion HE (Hv) | Surface hardness of bottom portion: Middle portion HM (Hv) | Ratio between surface hardness of foot-bottom central portion and surface hardness of middle portion (HM/HC) | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|---|---|---|---|---|---|---|---|
| 18 | Depth of 1 mm under surface | Pearlite | Pearlite | Pearlite | 460 | 310 | 405 | 0.885 | 230 | 18.0 | Controlling finish hot rolling temperature | Addition of Cr |
| | Depth of 5 mm under surface | Pearlite | Pearlite | Pearlite | 455 | 300 | 405 | | | | | |
| 19 | Depth of 1 mm under surface | Pearlite | Pearlite | Pearlite | 460 | 310 | 440 | 0.951 | 285 | 18.0 | Controlling finish hot rolling temperature + performing heat treatment and controlling cooling rate after hot rolling | Addition of Cr |
| | Depth of 5 mm under surface | Pearlite | Pearlite | Pearlite | 455 | 300 | 430 | | | | | |
| 20 | Depth of 1 mm under surface | Pearlite | Pearlite | Pearlite | 420 | 280 | 340 | 0.813 | 230 | 19.5 | Performing heat treatment after hot rolling | None |
| | Depth of 5 mm under surface | Pearlite | Pearlite | Pearlite | 410 | 275 | 335 | | | | Controlling cooling rate | |
| 21 | Depth of 1 mm under surface | Pearlite | Pearlite | Pearlite | 420 | 280 | 375 | 0.910 | 265 | 19.5 | Controlling finish hot rolling temperature + performing heat treatment and controlling cooling rate after hot rolling | None |
| | Depth of 5 mm under surface | Pearlite | Pearlite | Pearlite | 410 | 275 | 380 | | | | | |
| 22 | Depth of 1 mm under surface | Pearlite | Pearlite | Pearlite | 430 | 295 | 335 | 0.782 | 230 | 19.0 | Controlling re-heating temperature | Addition of Mo |
| | Depth of 5 mm under surface | Pearlite | Pearlite | Pearlite | 420 | 290 | 330 | | | | | |
| 23 | Depth of 1 mm under surface | Pearlite | Pearlite | Pearlite | 435 | 290 | 370 | 0.860 | 235 | 18.5 | Controlling finish hot rolling temperature | Addition of Nb + Ti |
| | Depth of 5 mm under surface | Pearlite | Pearlite | Pearlite | 425 | 285 | 370 | | | | | |
| 24 | Depth of 1 mm under surface | Pearlite | Pearlite | Pearlite | 435 | 290 | 400 | 0.924 | 280 | 18.5 | Controlling finish hot rolling temperature + performing heat treatment and controlling cooling rate after hot rolling | Addition of Nb + Ti |
| | Depth of 5 mm under surface | Pearlite | Pearlite | Pearlite | 425 | 285 | 395 | | | | | |
| 25 | Depth of 1 mm under surface | Pearlite | Pearlite | Pearlite | 420 | 290 | 350 | 0.837 | 230 | 18.0 | Controlling finish hot rolling temperature | Addition of Cr |
| | Depth of 5 mm under surface | Pearlite | Pearlite | Pearlite | 410 | 285 | 345 | | | | | |

TABLE 4-continued

| Example of invention | Position for observing microstructure and measuring hardness | Microstructure of bottom portion: Foot-bottom central portion | Microstructure of bottom portion: Foot-edge portion | Microstructure of bottom portion: Middle portion | Surface hardness of bottom portion: Foot-bottom central portion HC (Hv) | Surface hardness of bottom portion: Foot-edge portion HE (Hv) | Surface hardness of bottom portion: Middle portion HM (Hv) | Ratio between surface hardness of foot-bottom central portion and surface hardness of middle portion (HM/HC) | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|---|---|---|---|---|---|---|---|
| 26 | Depth of 1 mm under surface | Pearlite | Pearlite | Pearlite | 420 | 290 | 380 | 0.910 | 265 | 18.0 | Controlling finish hot rolling temperature + performing heat treatment and controlling cooling rate after hot rolling | Addition of Cr |
| | Depth of 5 mm under surface | Pearlite | Pearlite | Pearlite | 410 | 285 | 375 | | | | | |
| 27 | Depth of 1 mm under surface | Pearlite | Pearlite | Pearlite | 465 | 300 | 385 | 0.842 | 240 | 17.0 | Performing heat treatment after re-heating Controlling cooling rate | Addition of B |
| | Depth of 5 mm under surface | Pearlite | Pearlite | Pearlite | 450 | 295 | 385 | | | | | |
| 28 | Depth of 1 mm under surface | Pearlite | Pearlite | Pearlite | 415 | 290 | 365 | 0.878 | 225 | 17.5 | Performing heat treatment after hot rolling Controlling cooling rate | Addition of Mg + Ca |
| | Depth of 5 mm under surface | Pearlite | Pearlite | Pearlite | 405 | 280 | 355 | | | | | |
| 29 | Depth of 1 mm under surface | Pearlite | Pearlite | Pearlite | 500 | 315 | 410 | 0.818 | 240 | 16.5 | Controlling finish hot rolling temperature | Addition of V + N |
| | Depth of 5 mm under surface | Pearlite | Pearlite | Pearlite | 490 | 305 | 400 | | | | | |
| 30 | Depth of 1 mm under surface | Pearlite | Pearlite | Pearlite | 500 | 315 | 480 | 0.960 | 300 | 16.5 | Controlling finish hot rolling temperature + performing heat treatment and controlling cooling rate after hot rolling | Addition of V + N |
| | Depth of 5 mm under surface | Pearlite | Pearlite | Pearlite | 490 | 305 | 470 | | | | | |
| 31 | Depth of 1 mm under surface | Pearlite | Pearlite | Pearlite | 450 | 270 | 380 | 0.843 | 235 | 18.0 | Performing heat treatment after hot rolling Controlling cooling rate | Addition of REM |
| | Depth of 5 mm under surface | Pearlite | Pearlite | Pearlite | 440 | 265 | 370 | | | | | |

TABLE 4-continued

| Example of invention | Position for observing microstructure and measuring hardness | Microstructure of bottom portion: Foot-bottom central portion | Microstructure of bottom portion: Foot-edge portion | Microstructure of bottom portion: Middle portion | Surface hardness of bottom portion: Foot-bottom central portion HC (Hv) | Surface hardness of bottom portion: Foot-edge portion HE (Hv) | Surface hardness of bottom portion: Middle portion HM (Hv) | Ratio between surface hardness of foot-bottom central portion and surface hardness of middle portion (HM/HC) | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|---|---|---|---|---|---|---|---|
| 32 | Depth of 1 mm under surface | Pearlite | Pearlite | Pearlite | 405 | 280 | 315 | 0.781 | 225 | 18.5 | Performing heat treatment after hot rolling | None |
| | Depth of 5 mm under surface | Pearlite | Pearlite | Pearlite | 395 | 275 | 310 | | | | Controlling cooling rate | |
| 33 | Depth of 1 mm under surface | Pearlite | Pearlite | Pearlite | 405 | 280 | 390 | 0.969 | 280 | 17.0 | Controlling finish hot rolling temperature + performing heat treatment and controlling cooling rate after hot rolling | None |
| | Depth of 5 mm under surface | Pearlite | Pearlite | Pearlite | 395 | 275 | 385 | | | | | |
| 34 | Depth of 1 mm under surface | Pearlite | Pearlite | Pearlite | 475 | 300 | 360 | 0.761 | 235 | 17.5 | Performing heat treatment after hot rolling | Addition of Zr |
| | Depth of 5 mm under surface | Pearlite | Pearlite | Pearlite | 465 | 290 | 355 | | | | Controlling cooling rate | |
| 35 | Depth of 1 mm under surface | Pearlite | Pearlite | Pearlite | 480 | 310 | 400 | 0.842 | 240 | 16.5 | Controlling finish hot rolling temperature | Addition of Al |
| | Depth of 5 mm under surface | Pearlite | Pearlite | Pearlite | 470 | 305 | 400 | | | | | |

TABLE 5

| Comparative Example | Chemical composition (mass %) | | | | | | | | | | | | | | | | | | | |
|---|---|---|---|---|---|---|---|---|---|---|---|---|---|---|---|---|---|---|---|---|
| | C | Si | Mn | P | S | Cr | Mo | Co | B | Cu | Ni | V | Nb | Ti | Mg | Ca | REM | Zr | N | Al |
| 1 | 0.70 | 0.25 | 1.00 | 0.0150 | 0.0120 | 0.00 | — | — | — | — | — | — | — | — | — | — | — | — | — | — |
| 2 | 1.30 | 0.25 | 1.00 | 0.0150 | 0.0120 | 0.00 | — | — | — | — | — | — | — | — | — | — | — | — | — | — |
| 3 | 0.80 | 0.05 | 0.80 | 0.0180 | 0.0100 | 0.00 | — | — | — | — | — | — | — | — | — | — | — | — | — | — |
| 4 | 0.80 | 2.35 | 0.80 | 0.0180 | 0.0100 | 0.00 | — | — | — | — | — | — | — | — | — | — | — | — | — | — |
| 5 | 0.90 | 0.45 | 0.05 | 0.0120 | 0.0080 | 0.00 | — | — | — | — | — | — | — | — | — | — | — | — | — | — |
| 6 | 0.90 | 0.45 | 2.50 | 0.0120 | 0.0080 | 0.00 | — | — | — | — | — | — | — | — | — | — | — | — | — | — |
| 7 | 1.00 | 0.75 | 0.75 | 0.0300 | 0.0100 | 0.00 | — | — | — | — | — | — | — | — | — | — | — | — | — | — |
| 8 | 1.10 | 0.65 | 0.55 | 0.0120 | 0.0350 | 0.00 | — | — | — | — | — | — | — | — | — | — | — | — | — | — |
| 9 | 0.76 | 0.35 | 0.85 | 0.0140 | 0.0130 | 0.22 | — | — | — | — | — | — | — | — | — | — | — | — | — | — |
| 10 | 0.77 | 0.60 | 0.75 | 0.0200 | 0.0200 | 0.00 | — | — | — | 0.20 | — | — | — | — | — | — | — | — | — | — |
| 11 | 0.80 | 0.50 | 1.35 | 0.0070 | 0.0150 | 0.00 | — | — | — | — | — | — | — | — | — | — | — | — | — | — |
| 12 | 1.10 | 0.45 | 0.35 | 0.0080 | 0.0080 | 0.00 | — | — | — | — | — | — | — | — | — | — | — | — | — | — |
| 13 | 0.90 | 0.40 | 0.65 | 0.0120 | 0.0180 | 0.65 | — | — | — | — | — | — | — | — | — | — | — | — | — | — |
| 14 | 0.90 | 0.50 | 1.10 | 0.0150 | 0.0120 | 0.00 | — | — | — | — | — | — | — | — | — | — | — | — | — | — |
| 15 | 1.05 | 0.25 | 1.15 | 0.0150 | 0.0070 | 0.00 | — | — | — | — | — | 0.050 | — | — | — | — | — | — | 0.011 | — |
| 16 | 1.10 | 0.45 | 0.35 | 0.0080 | 0.0080 | 0.00 | — | — | — | — | — | — | — | — | — | — | — | — | — | — |
| 17 | 0.90 | 0.50 | 1.10 | 0.0150 | 0.0120 | 0.00 | — | — | — | — | — | — | — | — | — | — | — | — | — | — |
| 18 | 1.00 | 0.45 | 1.00 | 0.0135 | 0.0090 | 0.21 | — | — | — | — | — | — | — | — | — | — | — | — | — | — |
| 19 | 0.76 | 0.35 | 0.85 | 0.0140 | 0.0130 | 0.22 | — | — | — | — | — | — | — | — | — | — | — | — | — | — |
| 20 | 1.10 | 0.45 | 0.35 | 0.0080 | 0.0080 | 0.00 | — | — | — | — | — | — | — | — | — | — | — | — | — | — |

TABLE 6

| Comparative Example | Position for observing microstructure and measuring hardness | Microstructure of bottom portion | | |
|---|---|---|---|---|
| | | Foot-bottom central portion | Foot-edge portion | Middle portion |
| 1 | Depth of 1 mm under surface | Pearlite + proeutectoid ferrite | Pearlite + proeutectoid ferrite | Pearlite + proeutectoid ferrite |
| | Depth of 5 mm under surface | Pearlite + proeutectoid ferrite | Pearlite + proeutectoid ferrite | Pearlite + proeutectoid ferrite |
| 2 | Depth of 1 mm under surface | Pearlite + proeutectoid ferrite | Pearlite + proeutectoid cementite | Pearlite + proeutectoid cementite |
| | Depth of 5 mm under surface | Pearlite + proeutectoid ferrite | Pearlite + proeutectoid cementite | Pearlite + proeutectoid cementite |
| 3 | Depth of 1 mm under surface | Pearlite | Pearlite + proeutectoid cementite | Pearlite + proeutectoid cementite |
| | Depth of 5 mm under surface | Pearlite | Pearlite + proeutectoid cementite | Pearlite + proeutectoid cementite |
| 4 | Depth of 1 mm under surface | Pearlite + martensite | Pearlite | Pearlite |
| | Depth of 5 mm under surface | Pearlite + martensite | Pearlite | Pearlite |
| 5 | Depth of 1 mm under surface | Pearlite | Pearlite + proeutectoid ferrite | Pearlite |
| | Depth of 5 mm under surface | Pearlite | Pearlite + proeutectoid ferrite | Pearlite |
| 6 | Depth of 1 mm under surface | Pearlite + martensite | Pearlite | Pearlite |
| | Depth of 5 mm under surface | Pearlite + martensite | Pearlite | Pearlite |
| 7 | Depth of 1 mm under surface | Pearlite | Pearlite | Pearlite |
| | Depth of 5 mm under surface | Pearlite | Pearlite | Pearlite |
| 8 | Depth of 1 mm under surface | Pearlite | Pearlite | Pearlite |
| | Depth of 5 mm under surface | Pearlite | Pearlite | Pearlite |

| Comparative Example | Position for observing microstructure and measuring hardness | Surface hardness of bottom portion | | | Ratio between surface hardness of foot-bottom central portion and surface hardness of middle portion (HM/HC) |
|---|---|---|---|---|---|
| | | Foot-bottom central portion HC (Hv) | Foot-edge portion HE (Hv) | Middle portion HM (Hv) | |
| 1 | Depth of 1 mm under surface | 345 | 240 | 300 | 0.881 |
| | Depth of 5 mm under surface | 330 | 235 | 295 | |

TABLE 6-continued

| | | | | | |
|---|---|---|---|---|---|
| 2 | Depth of 1 mm under surface | 440 | 270 | 320 | 0.730 |
| | Depth of 5 mm under surface | 430 | 260 | 315 | |
| 3 | Depth of 1 mm under surface | 390 | 265 | 330 | 0.851 |
| | Depth of 5 mm under surface | 380 | 260 | 325 | |
| 4 | Depth of 1 mm under surface | 540 | 330 | 450 | 0.836 |
| | Depth of 5 mm under surface | 530 | 325 | 445 | |
| 5 | Depth of 1 mm under surface | 355 | 250 | 300 | 0.871 |
| | Depth of 5 mm under surface | 345 | 245 | 310 | |
| 6 | Depth of 1 mm under surface | 525 | 330 | 420 | 0.798 |
| | Depth of 5 mm under surface | 515 | 310 | 410 | |
| 7 | Depth of 1 mm under surface | 430 | 295 | 360 | 0.835 |
| | Depth of 5 mm under surface | 420 | 285 | 350 | |
| 8 | Depth of 1 mm under surface | 430 | 305 | 345 | 0.806 |
| | Depth of 5 mm under surface | 420 | 300 | 340 | |

TABLE 7

| | Position for observing | Microstructure of bottom portion | | | Surface hardness of bottom portion | | | Ratio between surface hardness of |
|---|---|---|---|---|---|---|---|---|
| Comparative Example | microstructure and measuring hardness | Foot-bottom central portion | Foot-edge portion | Middle portion | Foot-bottom central portion HC (Hv) | Foot-edge portion HE (Hv) | Middle portion HM (Hv) | foot-bottom central portion and surface hardness of middle portion (HM/HC) |
| 9 | Depth of 1 mm under surface | Pearlite | Pearlite | Pearlite | 370 | 250 | 310 | 0.836 |
| | Depth of 5 mm under surface | Pearlite | Pearlite | Pearlite | 360 | 240 | 300 | |
| 10 | Depth of 1 mm under surface | Pearlite | Pearlite | Pearlite | 345 | 290 | 320 | 0.934 |
| | Depth of 5 mm under surface | Pearlite | Pearlite | Pearlite | 335 | 280 | 315 | |
| 11 | Depth of 1 mm under surface | Pearlite | Pearlite | Pearlite | 350 | 255 | 350 | 1.007 |
| | Depth of 5 mm under surface | Pearlite | Pearlite | Pearlite | 340 | 245 | 345 | |
| 12 | Depth of 1 mm under surface | Pearlite | Pearlite | Pearlite | 405 | 250 | 315 | 0.776 |
| | Depth of 5 mm under surface | Pearlite | Pearlite | Pearlite | 400 | 240 | 310 | |
| 13 | Depth of 1 mm under surface | Pearlite | Pearlite | Pearlite | 520 | 310 | 405 | 0.786 |
| | Depth of 5 mm under surface | Pearlite | Pearlite | Pearlite | 510 | 300 | 405 | |
| 14 | Depth of 1 mm under surface | Pearlite | Pearlite | Pearlite | 420 | 320 | 340 | 0.813 |
| | Depth of 5 mm under surface | Pearlite | Pearlite | Pearlite | 410 | 320 | 335 | |
| 15 | Depth of 1 mm under surface | Pearlite | Pearlite | Pearlite | 530 | 330 | 410 | 0.768 |
| | Depth of 5 mm under surface | Pearlite | Pearlite | Pearlite | 525 | 325 | 400 | |
| 16 | Depth of 1 mm under surface | Pearlite | Pearlite | Pearlite | 505 | 280 | 315 | 0.619 |
| | Depth of 5 mm under surface | Pearlite | Pearlite | Pearlite | 505 | 275 | 310 | |
| 17 | Depth of 1 mm under surface | Pearlite | Pearlite | Pearlite | 420 | 280 | 435 | 1.042 |
| | Depth of 5 mm under surface | Pearlite | Pearlite | Pearlite | 410 | 275 | 430 | |

TABLE 7-continued

| Comparative Example | Position for observing microstructure and measuring hardness | Microstructure of bottom portion: Foot-bottom central portion | Foot-edge portion | Middle portion | Surface hardness of bottom portion: Foot-bottom central portion HC (Hv) | Foot-edge portion HE (Hv) | Middle portion HM (Hv) | Ratio between surface hardness of foot-bottom central portion and surface hardness of middle portion (HM/HC) |
|---|---|---|---|---|---|---|---|---|
| 18 | Depth of 1 mm under surface | Pearlite | Pearlite | Pearlite | 420 | 290 | 270 | 0.645 |
| | Depth of 5 mm under surface | Pearlite | Pearlite | Pearlite | 410 | 285 | 265 | |
| 19 | Depth of 1 mm under surface | Pearlite | Pearlite | Pearlite | 370 | 260 | 250 | 0.678 |
| | Depth of 5 mm under surface | Pearlite | Pearlite | Pearlite | 360 | 260 | 245 | |
| 20 | Depth of 1 mm under surface | Pearlite | Pearlite | Pearlite | 405 | 280 | 425 | 1.056 |
| | Depth of 5 mm under surface | Pearlite | Pearlite | Pearlite | 395 | 275 | 420 | |

TABLE 8

| Comparative Example | Result of fatigue test Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|
| 1 | 110<br>Generation of pro-eutectoid ferrite | 26.0 | Performing heat treatment after hot rolling<br>Controlling cooling rate | Lower limit of C |
| 2 | 135<br>Generation of pro-eutectoid cementite | 7.8<br>(decrease in toughness)<br>Generation of pro-eutectoid cementite | Performing heat treatment after hot rolling<br>Controlling cooling rate | Upper limit of C |
| 3 | 140<br>Generation of pro-eutectoid cementite | 8.0<br>(decrease in toughness)<br>Generation of pro-eutectoid cementite | Performing heat treatment after re-heating<br>Controlling cooling rate | Lower limit of Si |
| 4 | 95<br>Generation of martensite in central portion of bottom portion | 14.0<br>(decrease in toughness)<br>Hardening of pearlite | Performing heat treatment after re-heating<br>Controlling cooling rate | Upper limit of Si |
| 5 | 115<br>Generation of pro-eutectoid ferrite in foot-edge portion | 22.0 | Controlling temperature of re-heating | Lower limit of Mn |
| 6 | 100<br>Generation of martensite in central portion of bottom portion | 12.0<br>(decrease in toughness)<br>Hardening of pearlite | Controlling temperature of re-heating | Upper limit of Mn |
| 7 | 145<br>Increase in P content and embrittlement of pearlite | 9.0<br>(decrease in toughness)<br>Embrittlement of pearlite | Controlling temperature of finish hot rolling | Upper limit of P |
| 8 | 65<br>Generation of coarse MnS → stress concentration | 18.0 | Controlling temperature of finish hot rolling | Upper limit of S |

TABLE 9

| Comparative Example | Result of fatigue lest Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|
| 9 | 170<br>Softening of pearlite in foot-edge portion | 24.0 | Performing heat treatment after hot rolling<br>Cooling rate being out of range of present invention | Addition of Cr |
| 10 | 185<br>Softening of pearlite in foot-bottom central portion | 21.5 | Performing finish hot rolling<br>Temperature being out of range of present invention | Addition of Cu |
| 11 | 170<br>Softening of pearlite in foot-bottom central portion and foot-edge portion | 21.0 | Performing finish hot rolling<br>Temperature being out of range of present invention | None |

TABLE 9-continued

| Comparative Example | Result of fatigue lest Fatigue limit stress range of foot-bottom central portion (MPa) | Result of impact test performed on foot-edge portion (test temperature: 20° C.) Impact value (J/cm$^2$) | Special note for production method | Remark |
|---|---|---|---|---|
| 12 | 165 Softening of pearlite in foot-edge portion | 18.5 | Performing heat treatment after hot rolling Cooling rate being out of range of present invention | None |
| 13 | 150 Embrittlement of pearlite in foot-bottom central portion | 18.0 | Performing finish hot rolling Temperature being out of range of present invention | Addition of Cr |
| 14 | 215 | 12.0 (decrease in toughness) Hardening of pearlite | Performing heat treatment after hot rolling Cooling rate being out of range of present invention | None |
| 15 | 140 Embrittlement of pearlite in foot-bottom central portion | 9.5 (decrease in toughness) Hardening of pearlite | Performing finish hot rolling Temperature being out of range present invention | Addition of V + N |
| 16 | 155 Embrittlement of pearlite in foot-bottom central portion | 18.5 | Performing heat treatment after hot rolling Cooling rate being out of range of present invention | None |
| 17 | 150 Increase in hardness of middle portion → strain concentration on vicinity of foot-bottom central portion | 19.5 | Performing heat treatment after hot rolling Cooling rate being out of range of present invention | None |
| 18 | 130 Softening of pearlite in middle portion → strainvconcentration | 18.0 | Performing finish hot rolling Temperature being out of range of present invention | Addition of Cr |
| 19 | 110 Softening of pearlite in middle portion → strain concentration | 24.0 | Performing heat treatment after hot rolling Cooling rate being out of range of present invention | Addition of Cr |
| 20 | 140 Increase in hardness of middle portion → strain concentration in vicinity of foot-bottom central portion | 17.0 | Finish hot rolling temperature being out of range of present invention + cooling rate of heat treatment after hot rolling being out of range of present invention | None |

INDUSTRIAL APPLICABILITY

According to the present invention, it is possible to provide a rail having excellent breakage resistance and the fatigue resistance, which are required for the rail bottom portion of carbon railways, by controlling the compositions of rail steel serving as the material of the rail, controlling the metallographic structure of the rail bottom portion and the surface hardness of the foot-bottom central portion and the foot-edge portion of the rail bottom portion, controlling the balance of the surface hardness of the foot-bottom central portion, the foot-edge portion, and the middle portion, and controlling the strain concentration on the vicinity of the middle portion.

BRIEF DESCRIPTION OF THE REFERENCE SYMBOLS

1: FOOT-BOTTOM CENTRAL PORTION
2: FOOT-EDGE PORTION
3: MIDDLE PORTION
4: BOTTOM PORTION
5: OUTER SURFACE OF BOTTOM PORTION

What is claimed is:

1. A rail comprising, as steel composition, in terms of mass %:

C: 0.75% to 1.20%;
Si: 0.10% to 2.00%;
Mn: 0.10% to 2.00%;
Cr: 0% to 2.00%;
Mo: 0% to 0.50%;
Co: 0% to 1.00%;
B: 0% to 0.0050%;
Cu: 0% to 1.00%;
Ni: 0% to 1.00%;
V: 0% to 0.50%;
Nb: 0% to 0.050%;
Ti: 0% to 0.0500%;
Mg: 0% to 0.0200%;
Ca: 0% to 0.0200%;
REM: 0% to 0.0500%;
Zr: 0% to 0.0200%;
N: 0% to 0.0200%;
Al: 0% to 1.00%;
P: 0.0250% or less;
S: 0.0250% or less; and
Fe and impurities as a remainder, wherein 90% or more of a metallographic structure in a range between an outer surface of a rail bottom portion as an origin and a depth of 5 mm is a pearlite structure, an HC which is a surface hardness of a foot-bottom central portion is in a range of Hv 360 to 500, an HE which is a surface hardness of a foot-edge portion is in a range of Hv 260 to 315, and the HC, the HE, and an HM which is a surface hardness of a middle portion positioned between the foot-bottom central portion and the foot-edge portion satisfy the following Expression 1, $$HC \geq HM \geq HE \quad \text{(Expression 1).}$$

2. The rail according to claim 1, wherein the HM and the HC satisfy the following Expression 2, $$HM/HC \geq 0.900 \quad \text{(Expression 2).}$$

3. The rail according to claim 1, wherein the steel composition comprises, in terms of mass %, at least one selected from the group consisting of Cr: 0.01% to 2.00%,
Mo: 0.01% to 0.50%,
Co: 0.01% to 1.00%,
B: 0.0001% to 0.0050%,
Cu: 0.01% to 1.00%,
Ni: 0.01% to 1.00%,
V: 0.005% to 0.50%,
Nb: 0.0010% to 0.050%,
Ti: 0.0030% to 0.0500%,
Mg: 0.0005% to 0.0200%,
Ca: 0.0005% to 0.0200%,
REM: 0.0005% to 0.0500%,
Zr: 0.0001% to 0.0200%,
N: 0.0060% to 0.0200%, and
Al: 0.0100% to 1.00%.

4. The rail according to claim 2, wherein the steel composition comprises, in terms of mass %, at least one selected from the group consisting of Cr: 0.01% to 2.00%,
Mo: 0.01% to 0.50%,
Co: 0.01% to 1.00%,
B: 0.0001% to 0.0050%,
Cu: 0.01% to 1.00%,
Ni: 0.01% to 1.00%,
V: 0.005% to 0.50%,
Nb: 0.0010% to 0.050%,
Ti: 0.0030% to 0.0500%,
Mg: 0.0005% to 0.0200%,
Ca: 0.0005% to 0.0200%,
REM: 0.0005% to 0.0500%,
Zr: 0.0001% to 0.0200%,
N: 0.0060% to 0.0200%, and
Al: 0.0100% to 1.00%.

* * * * *